US009868577B2

(12) United States Patent
Ridgeway

(10) Patent No.: US 9,868,577 B2
(45) Date of Patent: Jan. 16, 2018

(54) PACKAGING ASSEMBLY

(71) Applicant: Sealed Air Corporation (US), Charlotte, NC (US)

(72) Inventor: Devin Ridgeway, Chula Vista, CA (US)

(73) Assignee: Sealed Air Corporation, Charlotte, NC (US)

( * ) Notice: Subject to any disclaimer, the term of this patent is extended or adjusted under 35 U.S.C. 154(b) by 0 days.

(21) Appl. No.: 15/510,001

(22) PCT Filed: Sep. 11, 2015

(86) PCT No.: PCT/US2015/049660

§ 371 (c)(1),
(2) Date: Mar. 9, 2017

(87) PCT Pub. No.: WO2016/040787

PCT Pub. Date: Mar. 17, 2016

(65) Prior Publication Data

US 2017/0247162 A1 Aug. 31, 2017

Related U.S. Application Data

(60) Provisional application No. 62/049,048, filed on Sep. 11, 2014.

(51) Int. Cl.
*B65D 81/02* (2006.01)
*B65D 81/05* (2006.01)
(Continued)

(52) U.S. Cl.
CPC ..... *B65D 81/05* (2013.01); *B65B 5/04* (2013.01); *B65B 7/20* (2013.01); *B65D 5/5028* (2013.01); *B65D 81/07* (2013.01)

(58) Field of Classification Search
CPC ..... B65D 5/04; B65D 5/5028; B65D 81/05; B65D 81/07; B65D 81/075
(Continued)

(56) References Cited

U.S. PATENT DOCUMENTS 5,893,462 A 4/1999 Ridgeway
5,894,932 A * 4/1999 Harding ..... B65D 81/075 206/583
(Continued)

OTHER PUBLICATIONS

Written Opinion of the International Searching Authority from the European Patent Office. dated Sep. 12, 2015.
(Continued)

*Primary Examiner* — Luan K Bui
(74) *Attorney, Agent, or Firm* — Jon M. Isaacson

(57) ABSTRACT

A frame (14) is useful in a packaging assembly including a box. The frame includes a panel (16) and a sheet (40). The panel has a panel length (L1) that is greater than the box length. The panel has a panel width (W1) that is greater than the box width. The panel defines a left slot (26) configured to receive the left closure flap of the box and a right slot (28) configured to receive the right closure flap of the box. The panel includes a left panel flap (30) extending from the left slot to the left edge (18) of the panel, a right panel flap (32) extending from the right slot to the right edge (20) of the panel, a front panel flap (34) extending from the left panel flap to the right panel flap; and a rear panel flap (36) extending from the left panel flap to the right panel flap. The left panel flap is foldably connected to the front panel flap and to the rear panel flap. The right panel flap is foldably connected to the front panel flap and the rear panel flap. The panel defines a panel opening (38) circumscribed by the left, right, front, and rear panel flaps. The sheet (40) is attached to the front panel flap and the rear panel flap and extends over the panel opening.

20 Claims, 30 Drawing Sheets

(51) Int. Cl.

| | |
|---|---|
| ***B65B 5/04*** | (2006.01) |
| ***B65B 7/20*** | (2006.01) |
| ***B65D 5/50*** | (2006.01) |
| *B65D 81/07* | (2006.01) |

(58) Field of Classification Search
USPC ..... 206/521, 583, 591–594
See application file for complete search history.

(56) References Cited

U.S. PATENT DOCUMENTS

| | | | | |
|---|---|---|---|---|
| 5,967,327 | A * | 10/1999 | Jones | B65D 5/5028 206/583 |
| 6,302,274 | B1 | 10/2001 | Ridgeway | |
| 7,882,956 | B2 * | 2/2011 | McDonald | B65D 5/5059 206/583 |
| 8,016,112 | B2 * | 9/2011 | Kasiwabara | B65D 5/5028 206/521 |
| 8,499,937 | B2 | 8/2013 | McDonald et al. | |
| 8,714,357 | B2 * | 5/2014 | Ridgeway | B65D 5/5028 206/583 |
| 2007/0095711 | A1 * | 5/2007 | Thompson | B65D 5/2009 206/522 |
| 2013/0233752 | A1 * | 9/2013 | Hammerschmidt | B65D 5/5028 206/471 |

OTHER PUBLICATIONS

International Search Report from the European Patent Office. dated Sep. 12, 2015.

* cited by examiner

PACKAGING ASSEMBLY

PACKAGING ASSEMBLY

Various embodiments of the present invention relate to frames useful in packaging assemblies for retaining a product in a box, and to the packaging assemblies incorporating those frames, for example, packaging assemblies used to protect a packaged product during shipment by retaining the product within a box.

BACKGROUND

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging assembly is known as "suspension packaging." In typical suspension packaging, the packaged product is suspended between two sheets each attached to opposing frames sized to fit within a corresponding box. Another type of packaging assembly is known as retention packaging. In typical retention packaging, a product is retained between a sheet and a rigid backing frame to which the sheet is attached. Examples of retention and suspension packaging are described in more detail in U.S. Pat. Nos. 4,852,743; 4,923,065; 5,071,009; 5,287,968; 5,388,701; 5,678,695; 5,893,462; 6,010,006; 6,148,590; 6,148,591; 6,289,655; 6,302,274; and 6,311,844, each of which is incorporated herein in its entirety by reference.

While existing retention structures provide a level of protection for the packaged object, there is room for improvement, for example, by enhancing the protective qualities and/or reducing the cost of the structure.

SUMMARY

A frame of the presently disclosed subject matter is useful in a packaging assembly for retaining a product within a box. The frame includes a panel and a sheet. The panel has a panel length from the left edge to the right edge of the panel. The panel length is greater than the box length. The panel has a panel width from the front edge to the rear edge of the panel. The panel width being greater than the box width. The panel defines a left slot configured to receive the left closure flap of the box and a right slot configured to receive the right closure flap of the box. The panel includes a left panel flap extending from the left slot to the left edge of the panel, a right panel flap extending from the right slot to the right edge of the panel, a front panel flap extending from the left panel flap to the right panel flap; and a rear panel flap extending from the left panel flap to the right panel flap. The left panel flap is foldably connected to the front panel flap and to the rear panel flap. The right panel flap is foldably connected to the front panel flap and the rear panel flap. The panel defines a panel opening circumscribed by the left, right, front, and rear panel flaps. The sheet is attached to the front panel flap and the rear panel flap and extends over the panel opening.

A packaging assembly for retaining a product includes a box and the above-described frame. The frame is positionable in an installed position having the left closure flap of the box extending through the left slot of the panel and the right closure flap of the box extending through the right slot of the panel. The packaging assembly is positionable in a retained position having the frame in the installed position, as well as the left panel flap and the left closure flap folded inwardly to place the left panel flap on top of the left closure flap, the right panel flap and the right closure flap folded inwardly to place to the right panel flap on top of the right closure flap, the front panel flap folded inwardly on top of the left panel flap and the right panel flap, the rear panel flap folded inwardly on top of the left panel flap and the right panel flap, the front closure flap folded inwardly on top of the front panel flap, and optionally the rear closure flap folded inwardly on top of the rear panel flap. A product placed on the sheet is retainable between the sheet and one or more of the left, right, front, and rear closure flaps.

These and other objects, advantages, and features of the presently disclosed subject matter will be more readily understood and appreciated by reference to the detailed description and the drawings.

Figure 1:
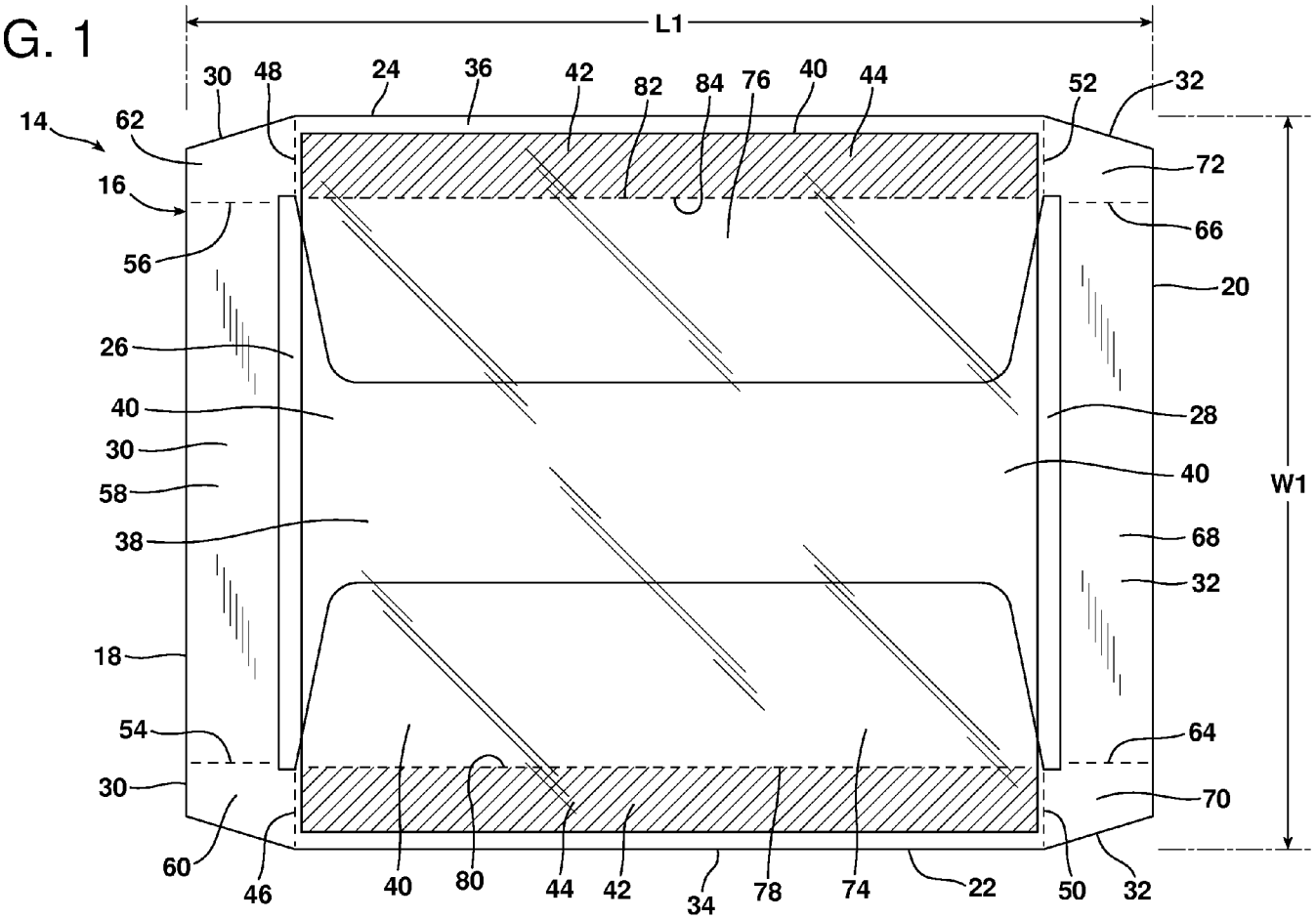
FIG. 1 is a representative top down plan view of a frame embodiment of the presently disclosed subject matter.

Various aspects of the subject matter disclosed herein are described with reference to the drawings. For purposes of simplicity, like numerals may be used to refer to like, similar, or corresponding elements of the various drawings. The drawings and detailed description are not intended to limit the claimed subject matter to the particular form disclosed. Rather, the intention is to cover all modifications, equivalents, and alternatives falling within the spirit and scope of the claimed subject matter.

DETAILED DESCRIPTION

The presently disclosed subject matter includes frames, for example frame 14 (FIGS. 1 and 10) and frame 114 (FIGS. 20-21), and packaging assemblies comprising those frames and a box (e.g., box 12) for example, packaging assembly 10 (FIGS. 2-9), packaging assembly 110 (FIGS. 11-19), and packaging assembly 210 (FIGS. 22-30), as described herein in more detail.

Frames

Frames of the various disclosed embodiments (e.g., frame 14 of FIG. 1 and frame 114 of FIG. 20) include a panel (e.g., panel 16 of FIG. 1 and panel 116 of FIG. 20) and a sheet (e.g., sheet 40) attached to the frame.

Figure 20:
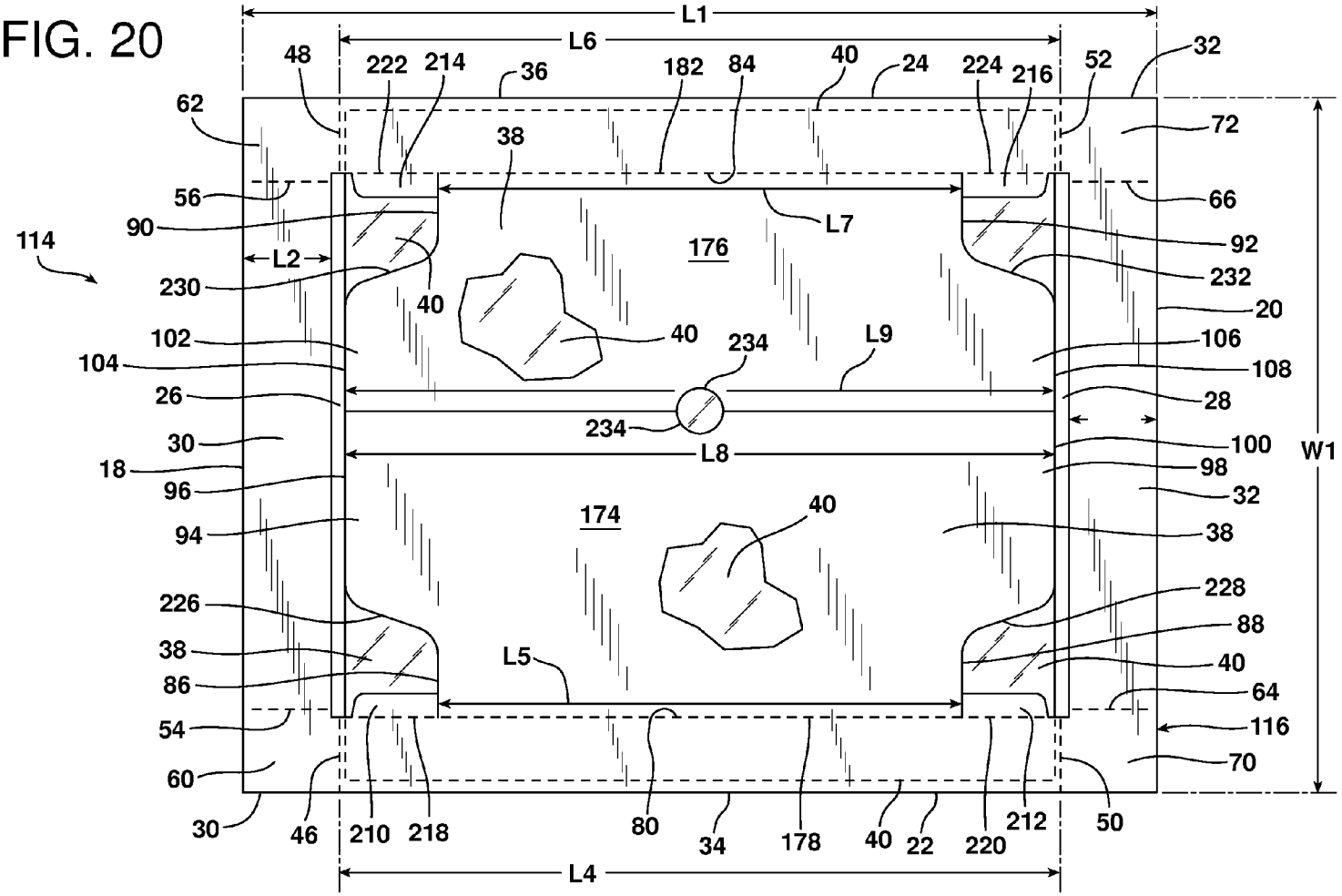
FIG. 20 is a representative top down view of another frame embodiment of the presently disclosed subject matter.

For example, in embodiments of the presently disclosed subject matter, frame 14 and frame 114 comprise a panel 16 having a panel length L1 measured from the outermost left edge 18 to the outermost right edge 20 of the panel. (FIGS. 1 and 20.) Panel 16 also has a panel width W1 measured from the outermost front edge 22 to the outermost rear edge 24. The L1 and W1 measurements are made generally perpendicular to the left and right edges, and the front and rear edges, respectively. As used herein, the term "generally" when used in conjunction with terms such as "parallel" or "perpendicular" or "coplanar" or "size" is meant to indicate that the parallel or perpendicular or coplanar orientation does not require mathematical precision, but rather indicates a moderate range of deviation from absolute parallel or perpendicular or coplanar that is commonly acceptable as a level of accuracy for these terms within the container-folding field.

Panels

Figure 10:
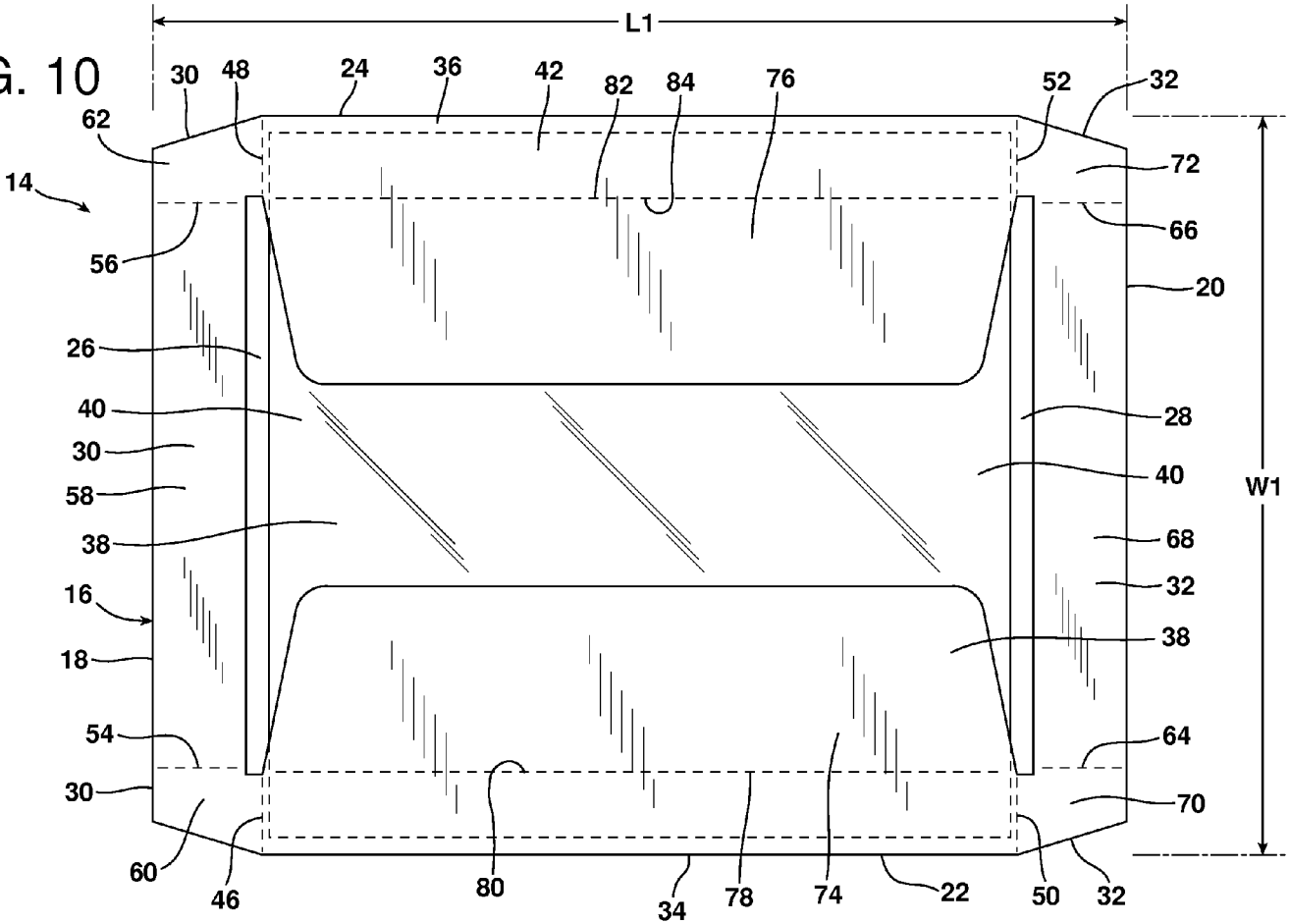
FIG. 10 is a representative top down view of the opposite side of the frame of FIG. 1.

Frames 14 and 114 comprise panel 16. (FIGS. 1, 10, and 20.) Panel 16 defines a left slot 26 and a right slot 28. Left slot 26 is configured (e.g., sized) to receive a left closure flap of a box and right slot 28 is configured (e.g., sized) to receive a right closure flap of a box, which will be described herein.

Panel 16 comprises a left panel flap 30 extending from the left slot 26 to the left edge 18 of the panel. The panel 16 comprises a right panel flap 32 extending from the right slot 28 to the right edge 20 of the panel. Front panel flap 34 extends from the left panel flap 30 to the right panel flap 32. Rear panel flap 36 extends from the left panel flap 30 to the right panel flap 32. (See, e.g., FIGS. 1, 10, and 20.)

The left panel flap 30 is foldably connected to the front panel flap 34 and to the rear panel flap 36. The right panel flap 32 is foldably connected to the front panel flap 34 and to the rear panel flap 36. The left panel flap 30 may be delineated from the front panel flap 34 by a first fold line 46 that is aligned with left slot 26. The left panel flap 30 may also be delineated from the rear panel flap 36 by second fold line 48 aligned with left slot 26. Right panel flap 32 may be delineated from front panel flap 34 by third fold line 50 aligned with right slot 28. Right panel flap 32 may also be delineated from rear panel flap 36 by fourth fold line 52 aligned with right slot 28. (See, e.g., FIGS. 1, 10, and 20.)

A "fold line" as used herein (and as depicted in the drawings as a broken line, for example as in FIG. 1) represents a line along which a panel, frame, or other material may be creased, crimped, embossed, perforated, scored, or otherwise weakened so as to enhance the foldability of the panel, frame, or other material along the fold line. For example, first fold line 46 may include one or more through slits (not shown) extending partially along its length, leaving a sufficient portion of the fold line intact to securely join left panel flap 30 to the front panel flap 34 so that the left panel flap 30 is foldably connected to the front panel flap 34. The use of slits through a fold line may facilitate folding by reducing the amount of panel material that has to be folded.

The left panel flap 30 may include a fifth fold line 54 and a sixth fold line 56, which extend generally perpendicularly from the left slot 26. The fifth and sixth fold lines delineate the left panel flap 30 into a left flap intermediate portion 58 between the fifth and sixth fold lines and a left front corner piece 60 and a left rear corner piece 62 on opposing ends of the left flap intermediate portion 58. (FIGS. 1, 10, and 20.)

The right panel flap 32 may include a seventh fold line 64 and an eighth fold line 66, which extend generally perpendicularly from the right slot 28. The seventh and eighth fold lines delineate the right panel flap 32 into a right flap intermediate portion 68 between the seventh and eighth fold lines and a right front corner piece 70 and a right rear corner piece 72 on opposing ends of the right flap intermediate portion 68. (FIGS. 1, 10, and 20.)

Panel 16 defines a panel opening 38 circumscribed by the left, right, front, and rear panel flaps 30, 32, 34, and 36. In the embodiments illustrated in FIGS. 1, 10, and 20, the panel opening 38 extends from the left slot 26 to right slot 28. Further, as illustrated in these embodiments, the left slot 26 may be contiguous with the panel opening 38, and the right slot 28 may be contiguous with the panel opening 38.

Panel Doors

The panel 16 may comprise front door 74 foldably connected to the front panel flap 34 and extending into panel opening 38. The front door 74 may be foldably connected to the front panel flap 34 along a front door fold line 78 along a front panel flap edge 80 adjacent the panel opening 38. The panel 16 may also comprise rear door 76 foldably connected to the rear panel flap 36 and extending into panel opening 38. The rear door 76 may be foldably connected to the rear panel flap 36 along a rear door fold line 82 along a rear panel flap edge 84 adjacent the panel opening 38. (See, e.g., FIGS. 1 and 10.)

In the frame embodiment 114 of FIG. 20, panel 116 comprises front door 174 foldably connected to the front panel flap 34 and extending into panel opening 38. The front door 174 may be foldably connected to the front panel flap 34 along a front door fold line 178 along a front panel flap edge 80 adjacent the panel opening 38. The panel 116 may also comprise rear door 176 foldably connected to the rear panel flap 36 and extending into panel opening 38. The rear door 176 may be foldably connected to the rear panel flap 36 along a rear door fold line 182 along a rear panel flap edge 84 adjacent the panel opening 38. (FIG. 20.)

Continuing with the frame 114 of FIG. 20, the left panel flap 30 has a left panel flap length L2 taken from the left slot 26 to the left edge 18. The right panel flap 32 has a right panel flap length L3 taken from the right slot 28 to the right edge 20. The front panel flap 34 has a front panel flap length L4 taken from the first fold line 46 to the third fold line 50. The front door 174 has a front door length L5 taken along the front door fold line 178 from the left edge 86 of the front door 174 to the right edge 88 of the front door 174. The front door length L5 may be less than the front panel flap length L4 minus the sum of the left panel flap length L2 and the right panel flap length L3 (i.e., L5<L4−(L2+L3)).

Continuing with FIG. 20, the rear panel flap 36 has a rear panel flap length L6 taken from the second fold line 48 to the fourth fold line 52. The rear door 176 has a rear door length L7 taken along the rear door fold line 182 from the left edge 90 of the rear door 176 to the right edge 92 of the rear door 176. The rear door length L7 may be less than the rear panel flap length L6 minus the sum of the left panel flap length L2 and the right panel flap length L3 (i.e., L7<L6−(L2+L3)).

This configuration for the lengths L2, L3, L5, and L7 of the left and right panel flaps and the front and rear doors may permit, for example, the left panel flap 30 and the right panel flap 32 to be folded inwardly without being blocked while the front door 174 and the rear door 176 are in an upward orientation. (See, e.g., FIG. 25 and discussion herein.)

The front door 174 may comprise a left door-tab portion 94 at the left edge 96 of the front door distal to the front door fold line 178 and a right door-tab portion 98 at the right edge 100 of the front door distal to the front door fold line 178. The rear door 176 may comprise a left door-tab portion 102 at the left edge 104 of the rear door distal to the rear door fold line 182 and a right door-tab portion 106 at the right edge 108 of the rear door distal to the rear door fold line 182. A front tab spacing length L8 taken from the left edge 96 to the right edge 100 may be greater than the front door length L5. Similarly, a rear tab spacing length L9 taken from the left edge 102 to the right edge 108 may be greater than the rear door length L7. (FIG. 20.)

Figure 24:
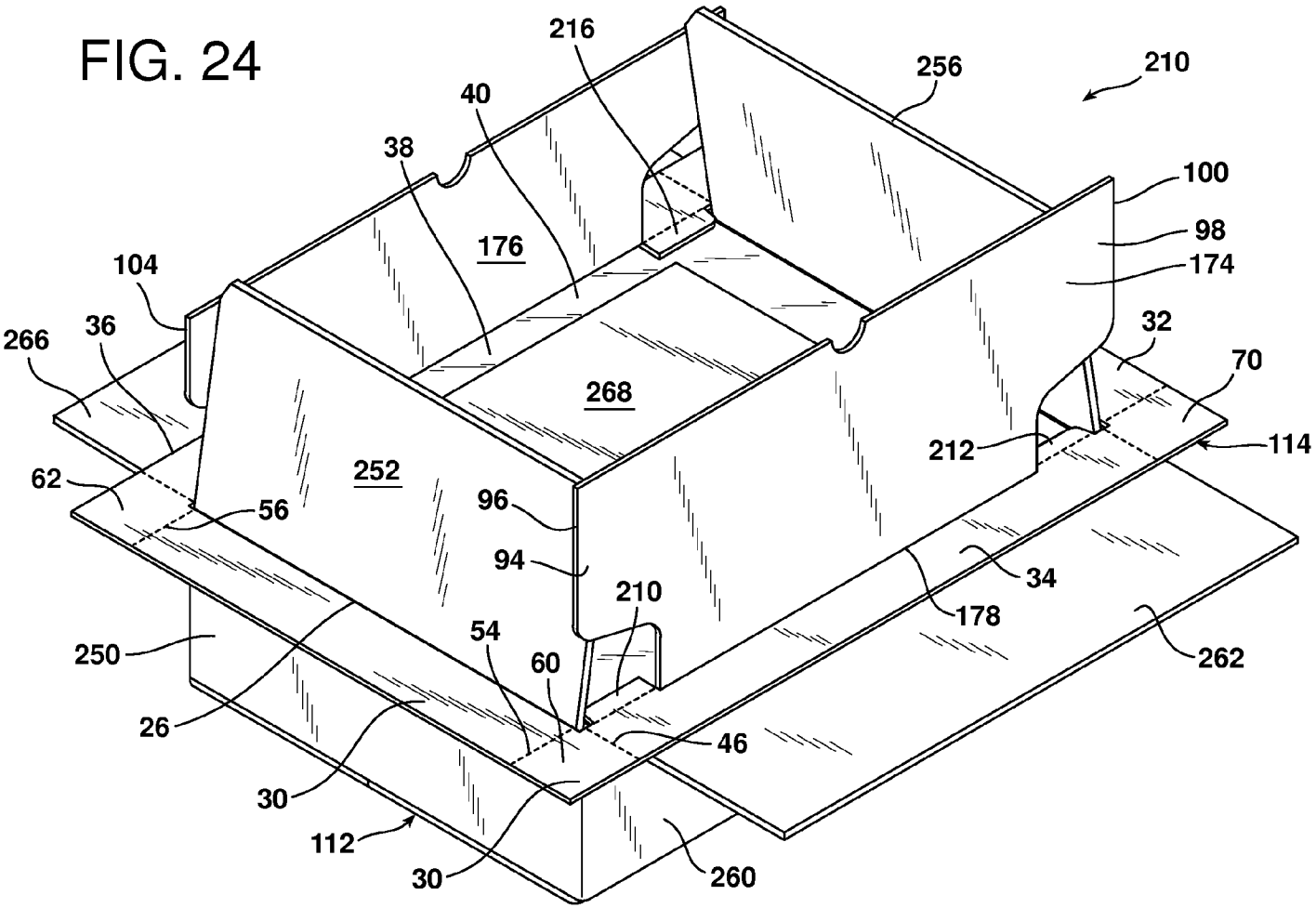
FIG. 24 is a representative perspective view of the packaging assembly of FIG. 23, but having a product to be packaged placed on the sheet.

This configuration for the lengths L8 and L9 relative the front and rear door lengths L5 and L7 may permit the front door 174 and rear door 176, when lifted upwardly, to extend beyond the distance between the upwardly-oriented left and right closure flaps 252, 256 of the box 12, such that the front and rear doors may be held in an open or upward orientation, as illustrated in FIG. 24.

The front door 174 defines a left front cutaway opening 226 at the left extent of the front door 174. The area of the left front cutaway opening 226 may be defined as the area within the panel opening 38 that is also within the border defined by the left extent of the front door 174, the front panel flap 34, and the left slot 26. The area of the left front cutaway opening 226 may be at least as large as the area of the left front corner piece 60.

The front door 174 defines a right front cutaway opening 228 at the right extent of the front door 174. The area of the right front cutaway opening 226 may be defined as the area within the panel opening 38 that is also within the border defined by the right extent of the front door 174, the front panel flap 34, and the right slot 28. The area of the right front cutaway opening 228 may be at least as large as the area of the right front corner piece 70.

The rear door 176 defines a left rear cutaway opening 230 at the left extent of the rear door 176. The area of the left rear cutaway opening 230 may be defined as the area within the panel opening 38 that is also within the border defined by the left extent of the rear door 176, the rear panel flap 36, and the left slot 26. The area of the left front cutaway opening 230 may be at least as large as the area of the left rear corner piece 62.

The rear door 176 defines a right rear cutaway opening 232 at the right extent of the rear door 176. The area of the right rear cutaway opening 232 may be defined as the area within the panel opening 38 that is within the border defined by the right extent of the rear door 176, the rear panel flap 36, and the right slot 28. The area of the right rear cutaway opening 232 may be at least as large as the area of the right rear corner piece 72.

Figure 25:
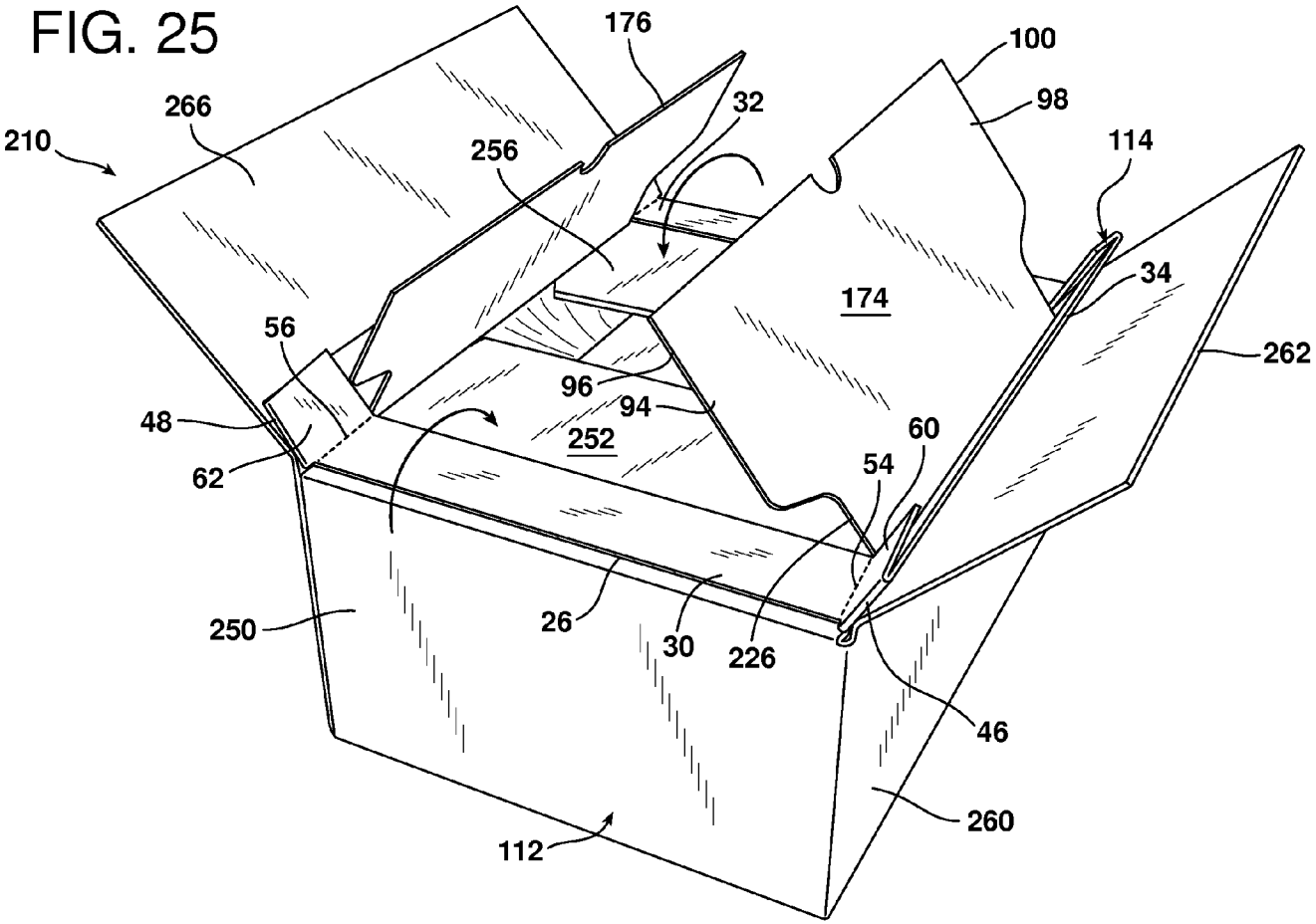
FIG. 25 is a representative perspective view of the packaging assembly of FIG. 24, but having the left and right closure flaps of the box folded inwardly and the left and right panel flaps of the frame folded inwardly.

At least one edge of these cutaway openings 226, 228, 230, 232 may have an arcuate configuration, which may be configured and sized to accommodate the closing of the left and right panel flaps while the front and rear doors are in an upward orientation, as shown in FIGS. 24-25.

The front and rear doors may be of generally equal size, for example, as illustrated in FIG. 1. Alternatively the front and rear doors may be of unequal size, for example, as illustrated in FIG. 20. The front and rear doors may have a configuration such that they "meet" (that is, correspond or align with each other along a cut line between the doors) in the panel opening 38, for example, as illustrated in FIG. 20. A panel has a given centerline equidistant between the front and rear panel flaps. The front and rear doors may meet in the panel opening 38 along that centerline, or alternatively, the front and rear doors may meet in the panel opening along a line that is off of that centerline, for example, as illustrated in FIG. 20.

Either or both of the front and rear doors may define one or more apertures, indents, or cutaway portions as finger holds, for example, finger holds 234 of FIG. 20.

Panel Tabs

The panel may also comprise one or more of a front left panel tab 210, a front right panel tab 212, a left rear panel tab 214, and a right rear panel tab 216. (FIG. 20.) Front left panel tab 210 is foldably connected to the front panel flap 30 along fold line 218 between the left panel flap 30 and the front door 174, and extends from the front panel flap 30 into the panel opening 38. Front right panel tab 212 is foldably connected to the front panel flap 30 along fold line 2220 between the right panel flap 32 and the front door 174, and extends from the front panel flap 30 into the panel opening 38. Rear left panel tab 214 is foldably connected to the rear panel flap 36 along fold line 222 between the left panel flap 30 and the rear door 176, and extends from the rear panel flap 32 into the panel opening 38. Rear right panel tab 216 is foldably connected to the rear panel flap 36 along fold line 224 between the right panel flap 32 and the rear door 176, and extends from the rear panel flap 36 into the panel opening 38. (FIG. 20.)

Panel Compositions

Panel 16, and any of the panels and/or boxes of the various embodiments described herein, may comprise a substantially rigid, lightweight, foldable material, for example, panel 16, or any of the portions of panel 16 described herein, may be formed of one or more of any of the following materials: cellulosic-based materials (e.g., cardboard, corrugated cardboard, paperboard, chipboard), plastic, and compressed foam. For example, panel 16 may comprise corrugated cardboard, for example, any of single-wall B-flute, C-flute, and/or E-flute corrugated cardboard, B/C double-wall corrugated cardboard, and/or E/B double-wall corrugated cardboard; and for example having the minimum bursting strength (per Mullen Bursting Test) of any of non-test, 150, 175, 200, 250, 275, and 350 psi. The panel, and any of the panels and frames of the various embodiments described herein, may have an average thickness of, for example, at most, and/or at least, any of the following thicknesses: 0.03, 0.06, 0.12, 0.18, 0.25, 0.3, 0.4, and 0.5 inches.

Sheets

In an embodiment, frame 14 comprises sheet 40 attached to the front panel flap 34 and the rear panel flap 36 of panel 16, and extending over (i.e., across) the panel opening 38. In the drawings, sheet 38 is shown completely covering panel opening 38; in alternative embodiments the sheet may extend over the panel opening and only partially cover the panel opening (not illustrated). The sheet 40 may be extended over the panel opening 38 such that the sheet does not cover either or both of the left and right slots 26, 28. Further, the sheet may extend over the panel opening such that it only partially covers the panel opening. (Not illustrated.) Also, one or more sheets, such as a total of any of one, two, three, or four may be used to extend over the panel opening and attach to the front and rear panel flaps.

Figure 21:
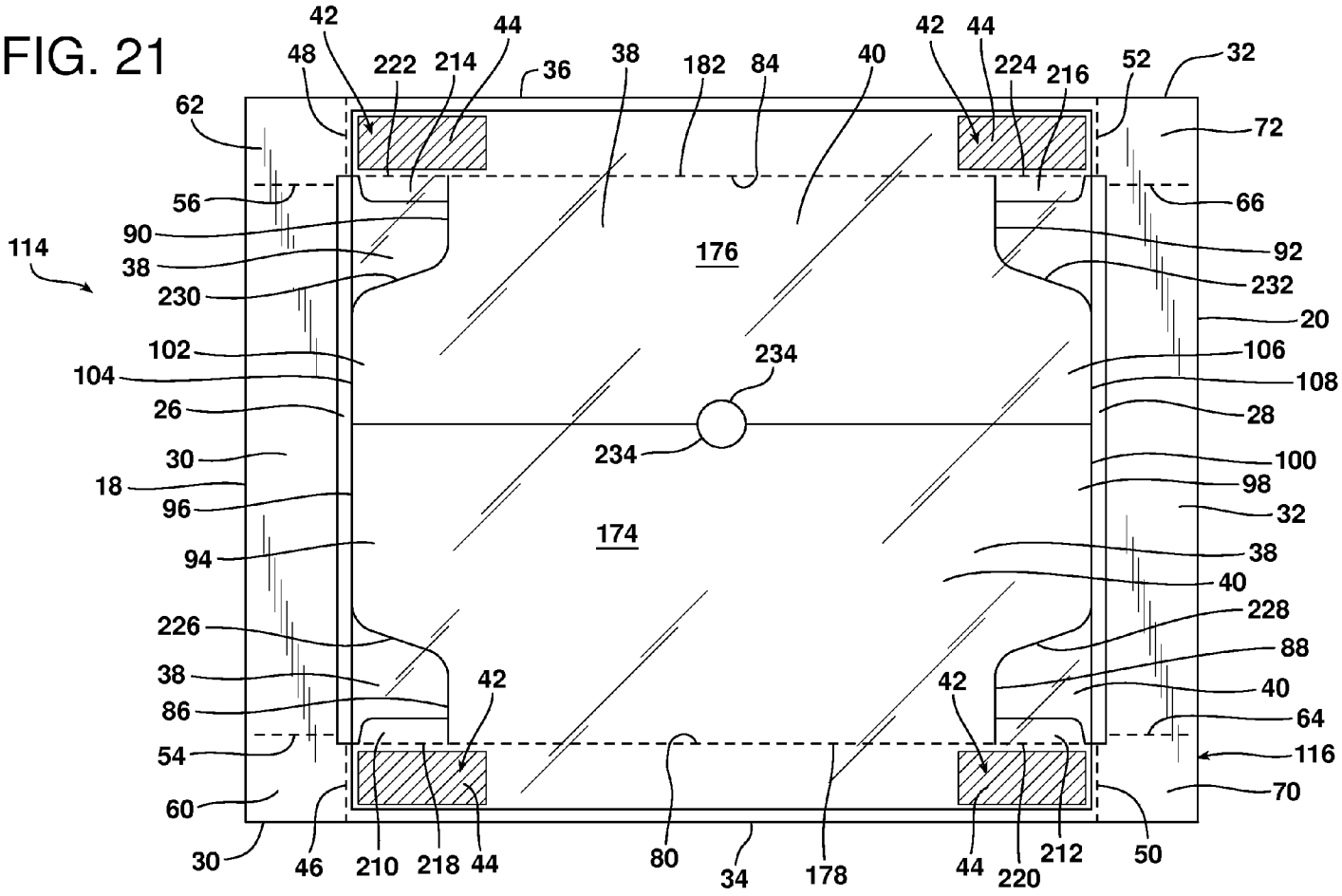
FIG. 21 is a representative top down view of the opposite side of the frame embodiment shown in FIG. 20.

Sheet 40 may be attached to panel 16, for example to the front panel flap 34 and the rear panel flap 36, by any of the ways described herein. In the drawings, sheet 40 is attached to panel 16 along attachment zones 42 comprising adhesive 44. As shown, an attachment zone 42 may extend continuously along the length of front panel flap 34 and rear panel flap 36. However, attachment zones 42 may alternatively extend discontinuously or periodically as shown in FIG. 21, for example having attachment areas corresponding to one or more regions along the length of front panel flap 34 and rear panel flap 36.

In the drawings, sheet 40 is shown attached to the panel 16 by adhering with adhesive 44; however, the sheet may be attached to the panel, for example, by one or more of any of the following: adhering (e.g., with hot melt adhesive), gluing, heat welding, ultrasonic welding, stapling, tacking, fastening, clipping (see, e.g., U.S. Pat. No. 5,694,744 to Jones, which is incorporated herein in its entirety by reference), tab/slot engagement (see, e.g., U.S. Pat. No. 6,073,761 to Jones, which is incorporated herein in its entirety by reference), anchoring, retaining and/or securing (see, e.g., U.S. Patent Application Publication 2004/0108239 A1 to McDonald et al. published Jun. 10, 2004, which is incorporated herein in its entirety by reference, and which discloses a sleeve having pockets or pouches for receiving a flap as shown in FIGS. 24-25 and related discussion therein). The sheets of any embodiments described herein may be attached by one or more of any of the attachment ways described herein.

Useful types of adhesives for attaching sheets to panels are known to those of skill in the art, and as those of ordinary skill know depend on the composition of the materials to be adhered. For example, a polyurethane-based sheet may be adhered with a polyurethane-based adhesive, such as a water-borne aliphatic polyurethane dispersion.

Sheet 40, and any of the sheets of the various embodiments described herein, may comprise any of the materials, compositions, and polymers set forth herein with respect to sheets, and may have any thickness, properties, treatments, additives, and other characteristics (e.g., flexibility, elasticity, optics, strength, elastic recovery, transparency, load tear resistance, puncture resistance) as set forth herein with respect to sheets.

Sheet 40 may have a composition and thickness providing acceptable performance properties (e.g., flexibility, elasticity, optics, strength) for the given packaging application of expected use. The sheet may have a thickness of at most any of the following: 10 mils, 6 mils, 5 mils, 4 mils, 3 mils, 2 mils, 1.5 mils, and 1 mil. (A "mil" is equal to 0.001 inch.) The sheet may also have a thickness of at least any of the following: 0.5 mils, 1 mil, 1.5 mils, 2 mils, and 3 mils.

The sheet may have an elastic recovery in either or both of the transverse and longitudinal directions of at least any of the following values: 60%, 65%, 70%, 75%, 80%, and 85%, measured according to ASTM D5459 at 100% strain, 30 seconds relaxation time, and 60 second recovery time.

The sheet may have a maximum load tear resistance in either or both of the transverse and longitudinal directions of at least any of the following values: 400, 450, 500, 550, and 600 grams force, measured according to ASTM D1004.

The sheet may have a slow puncture maximum load of at least any of the following values: 4, 4.5, 5, 5.5, 6, 6.5, and 7 pounds force, measured according to ASTM F1306 using a crosshead speed of 5 inches per minute.

The sheet may have a Young's modulus sufficient to withstand the expected handling and use conditions, yet may provide a "soft" feel that may be desirable for a packaging application. The sheet may have a Young's modulus of at least any of the following values: 2,000; 2,500; 3,000; 3,500; and 4,000 pounds/square inch. The sheet may have a Young's modulus of no more than about any of the following values: 8,000; 10,000; 15,000; 20,000; 30,000; and 40,000 pounds/square inch. The Young's modulus is measured in accordance with ASTM D882, measured at a temperature of 73° F.

The sheet may be transparent so that the packaged article (e.g., product 28) may be visible through the sheet. "Transparent" as used herein means that the material transmits incident light with negligible scattering and little absorption, enabling objects to be seen clearly through the material under typical unaided viewing conditions (i.e., the expected use conditions of the material). The transparency (i.e., clarity) of the retention sheet may be at least any of the following values: 65%, 70%, 75%, 80%, 85%, and 90%, measured in accordance with ASTM D1746.

The sheet may have a heat-shrink attribute. For example, the sheet may have any of a free shrink in at least one direction (i.e., machine or transverse directions), in each of at least two directions (i.e., machine and transverse directions), measured at any of 160° F. and 180° F. of at least any of the following: 7%, 10%, 15%, 20%, 25%, 30%, 40%, 50%, 55%, 60%, and 65%. Alternatively, the sheet may be non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

The sheet may comprise, for example, one or more fabrics, such as one or more of the following: wovens, knits, nonwovens, and openwork meshes (e.g., netting), spandex, including Lycra® brand spandex, and elastic fabrics.

The sheet may comprise one or more polymers, for example, one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth) acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). The sheet may also comprise thermoplastic polyolefin elastomers (TPOs), which are two-component elastomer systems comprising an elastomer (such as EPDM) finely dispersed in a thermoplastic polyolefin (such as polypropylene or polyethylene). "Copolymer" as used in this application means a polymer derived from two or more types of monomers, and includes terpolymers, etc.

A sheet comprising polyolefin (e.g., polyethylene), polyvinyl chloride, and/or polyurethane may be useful for lightweight applications, for example, where a sheet thickness of from 2 to 4 mils may be desirable. A sheet comprising polyurethane may provide desirable elastomeric, puncture resistance, temperature resistance, and tackiness characteristics.

The sheet may comprise effective amounts of one or more of tackifiers, antiblocking agents, and slip agents—or may be essentially free of any of these components. Tackifiers, antiblocking agents, and slip agents, and their effective amounts, are known to those of ordinary skill in the art.

The sheet may be manufactured by thermoplastic film-forming processes known in the art (e.g., tubular or blown-film extrusion, coextrusion, extrusion coating, flat or cast film extrusion). A combination of these processes may also be employed.

At least one side of the sheet may be corona and/or plasma treated to change the surface energy of the sheet, for example, to increase the ability of the sheet to adhere to a panel or frame.

Films that may be useful as sheets are described in U.S. Pat. No. 6,913,147 issued Jul. 5, 2005 and entitled "Packaging Structure Having a Frame and Film," which is incorporated herein in its entirety by reference.

Packaging Assemblies

A packaging assembly may comprise any of the various embodiments of frames of the disclosed subject matter herein and a box 12.

Box 12 (as illustrated in the drawings, e.g., FIGS. 2, 11, and 22) comprises a polyhedron-shaped storage compartment, in which the side walls, bottom, and closure flaps are polygon-shaped (e.g., rectangular). Useful box types are known to those of skill in the field, and include containers of the RSC (regular slotted container) type, AFM (all flaps meet) type, POL (partial overlap) type, FOL (full overlap) type, STE (standard tuck end) type, and RTE (reverse tuck end) type. The latter STE and RTE types lack the rear closure flap described herein.

Box 12 comprises a left wall 250 and a left closure flap 252 foldably connected to the top of the left wall 252. Right wall 254 opposes the left wall 252. A right closure flap 256 is foldably connected to the top of the right wall 254. A front wall 260 extends from the left wall 250 to the right wall 254. Front closure flap 262 is foldably connected to the top of the front wall 260. Rear wall 264 opposes the front wall 260 and extends from the left wall 250 to the right wall 254. Rear closure flap 266 is foldably connected to the top of the rear wall 264. Rear closure flap 266 may be optional, that is may not be present, for example in the case where standard tuck end (STE) or reverse tuck end (RTE) boxes (not illustrated) are used.

Figure 2:
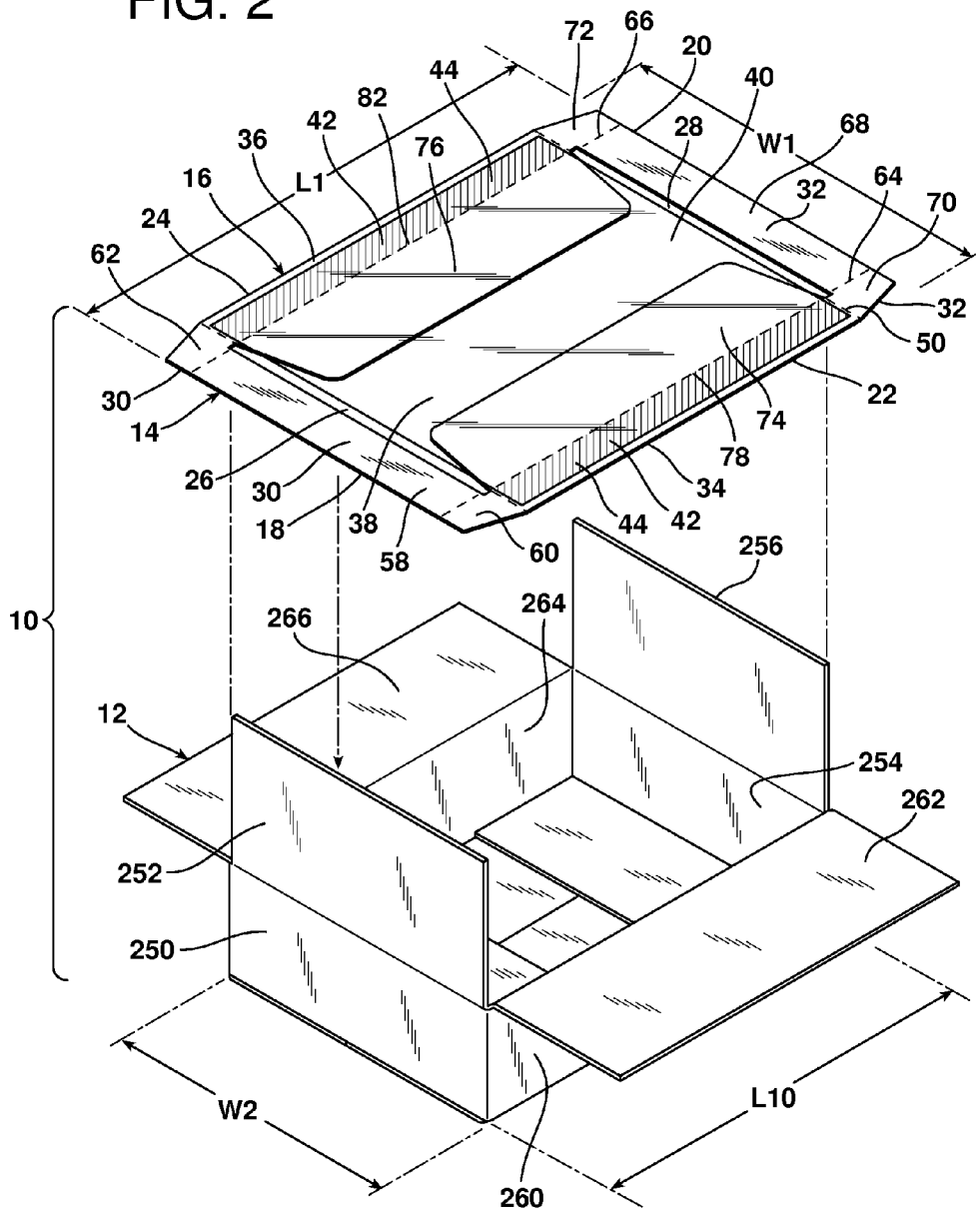
FIG. 2 is a representative perspective view of a packaging assembly embodiment of the presently disclosed subject matter comprising the frame of FIG. 1 and a box.

Box 12 has a given box length L10 from the left to the right, and a given box width W2 from the front to the rear of the box, as illustrated in FIG. 2.

The box may be configured such that the front and rear walls of the box have a different height than the left and right walls of the box. For example, as illustrated with box 112 of FIGS. 22, 27, the front and rear walls of box 112 have a first height H1 and the left and right walls 250, 254 of the box 112 have a second height H2. The first height H1 may be greater than the second height H2. If material used for the panel 116 has a given thickness T, then the relative heights of the walls may be configured such that the difference between the first height H1 and the second height H2 is greater than twice the frame given thickness T (i.e., H1−H2>2 T).

For the packaging assemblies of the disclosed subject matter, the frame 14, 114 is positionable (i.e., is configured relative the box to be positioned) in an installed position having the left closure flap 252 of the box extending through the left slot 26 of the panel and the right closure flap 256 of the box extending through the right slot 28 of the panel. FIGS. 3-9, 12-19, and 23-30 illustrate the frame in an installed position. (FIGS. 1-2, 10-11, and 20-23 illustrate the frame in an un-installed position.)

Figure 5:
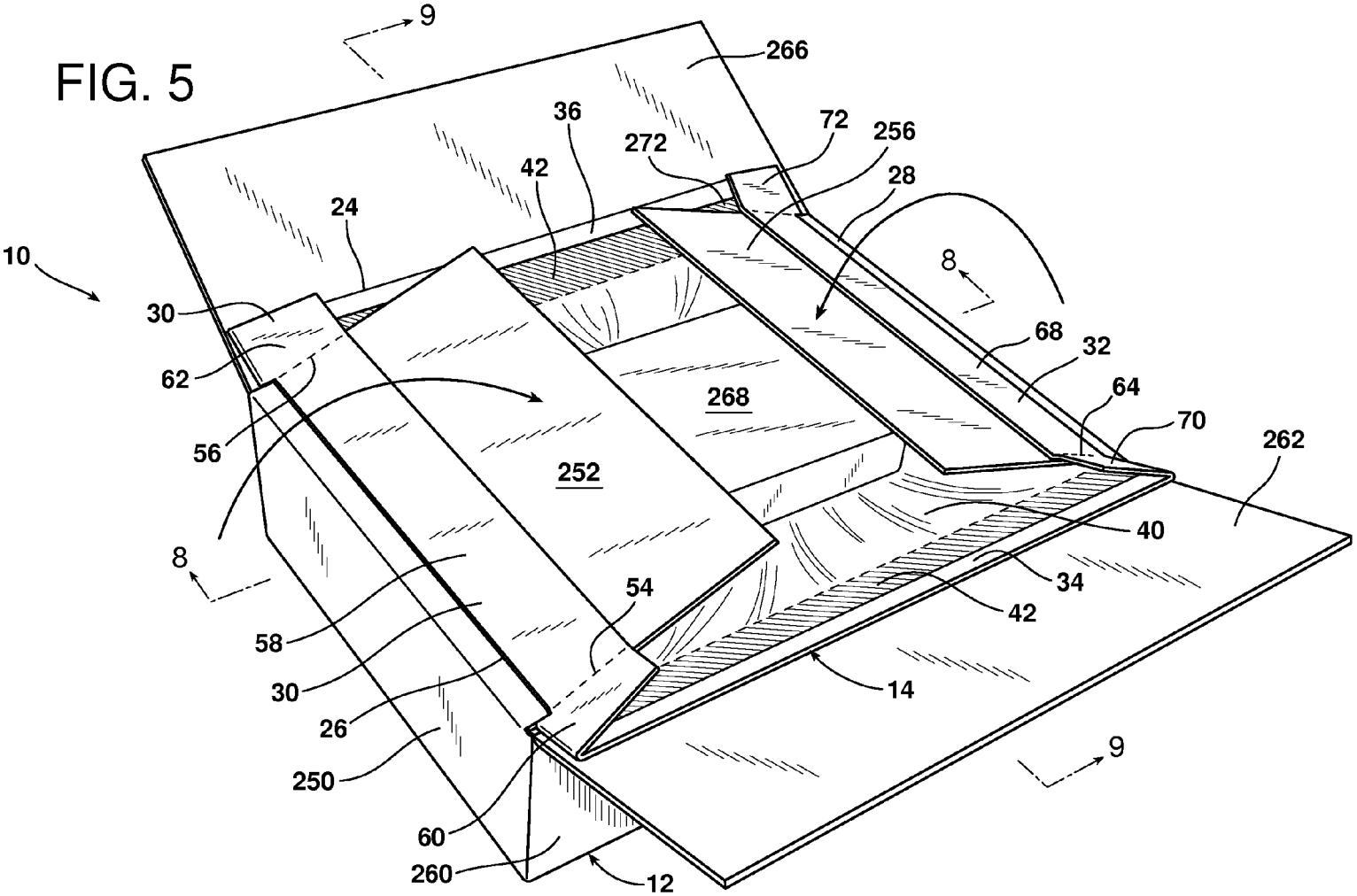
FIG. 5 is a representative perspective view of the packaging assembly of FIG. 4, but having the left and right closure flaps of the box folded inwardly.
Figure 6:
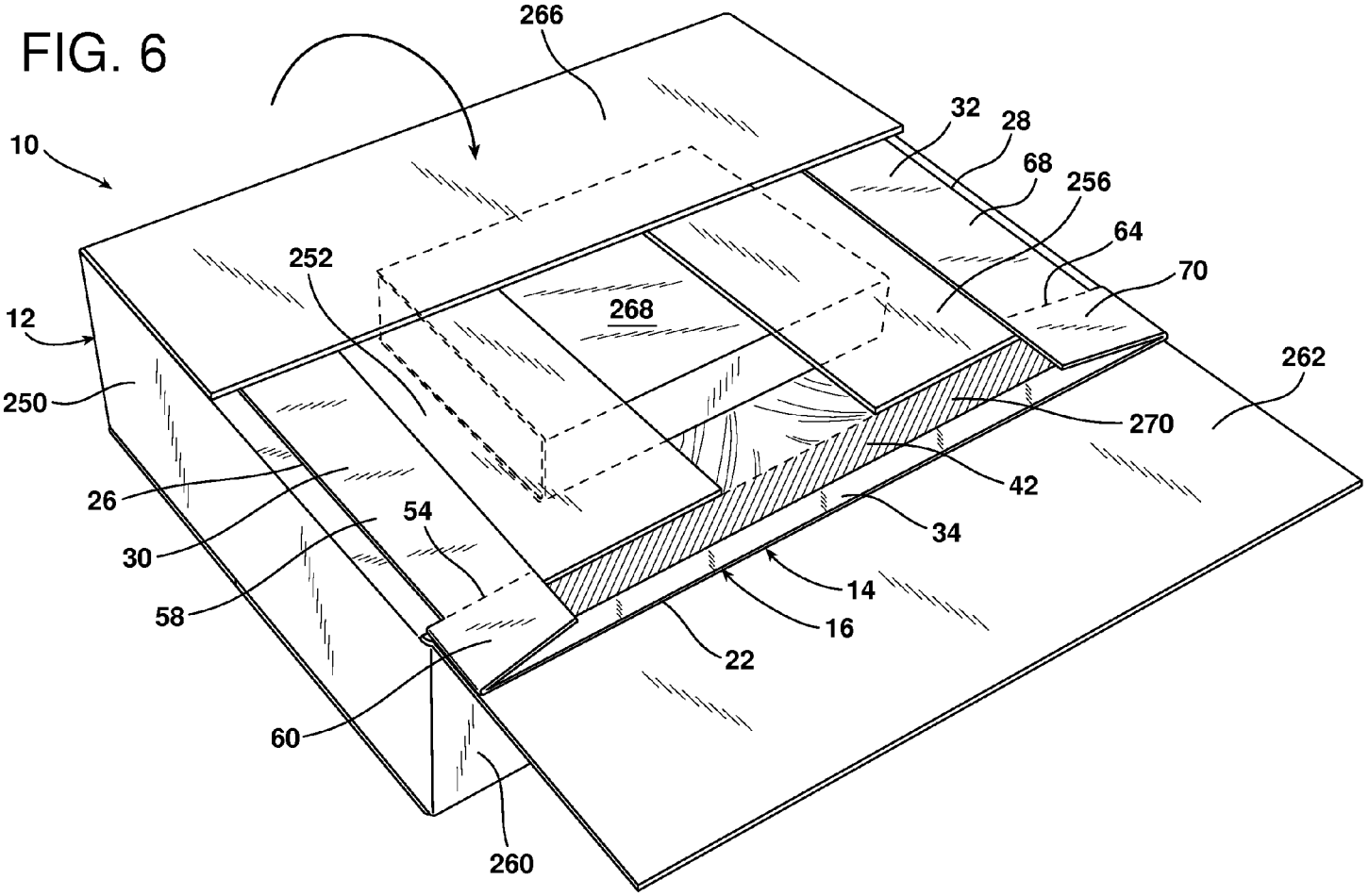
FIG. 6 is a representative perspective view of the packaging assembly of FIG. 5, but having the rear closure flap folded inwardly.
Figure 7:
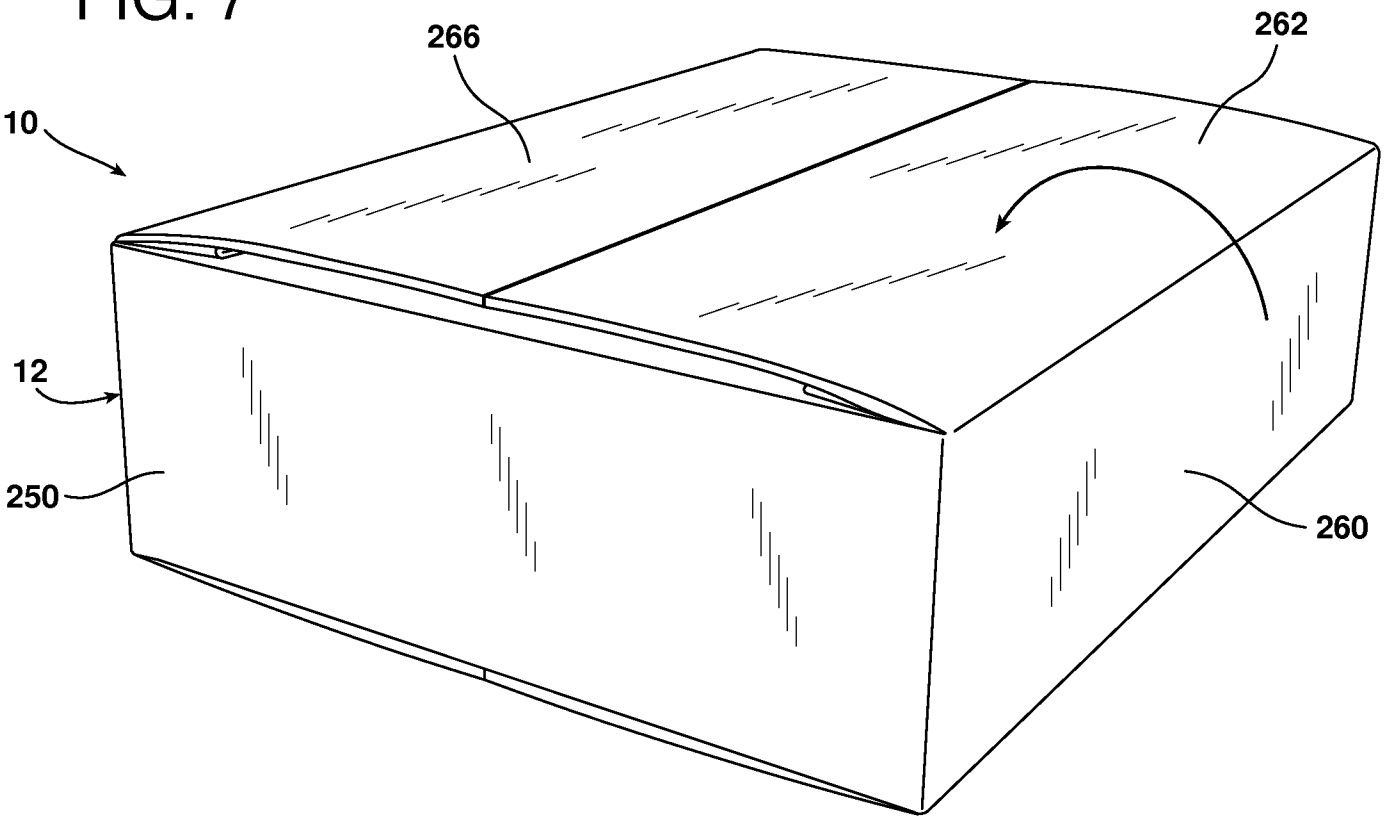
FIG. 7 is a representative perspective view of the packaging assembly of FIGS. 2 to 6, but in the retained position with the box closed.
Figure 8:
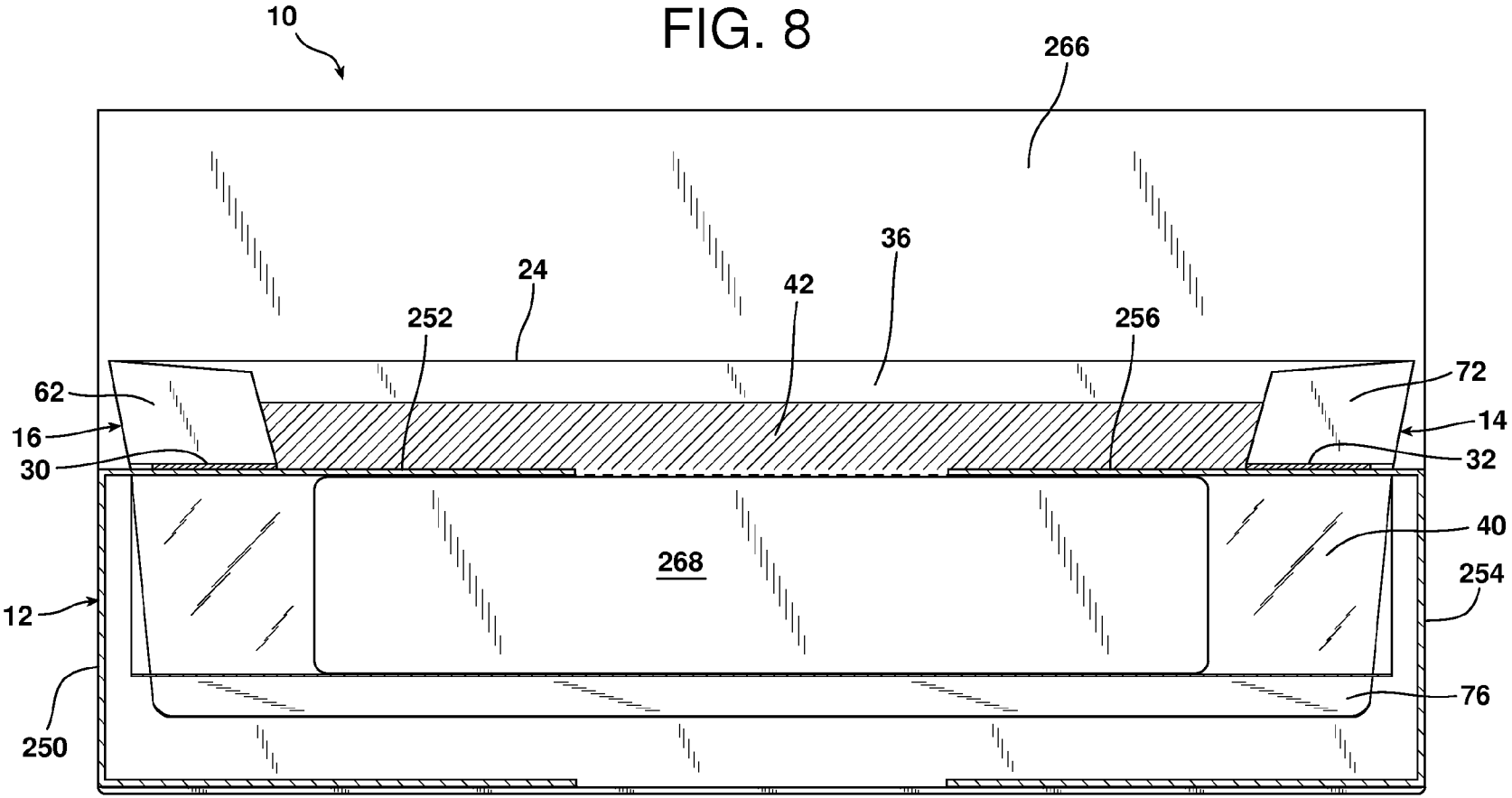
FIG. 8 is a representative sectional view taken along the line 8-8 of FIG. 5, but having the left and right closure flaps 252, 256 further inward in a closed position.
Figure 9:
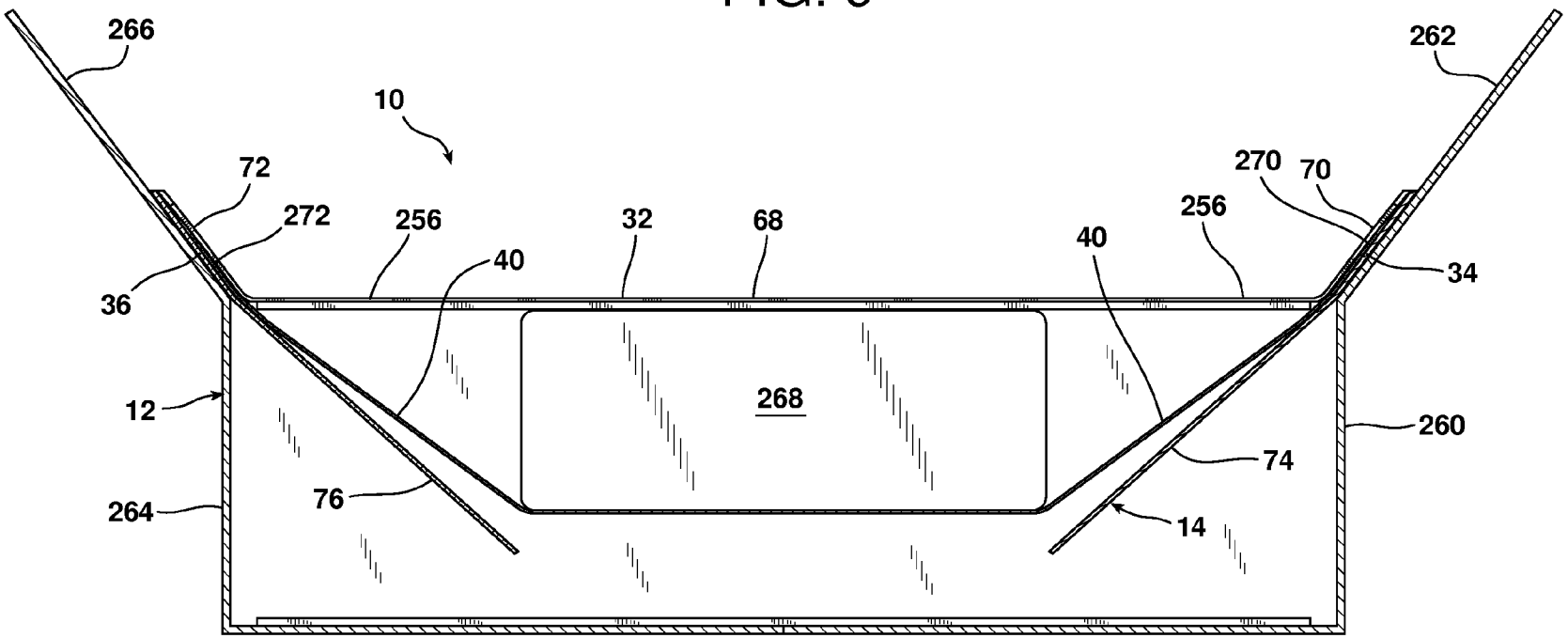
FIG. 9 is a representative sectional view taken along the line 9-9 of FIG. 5, but having the right closure flap 256 further inward in a closed position.
Figure 16:
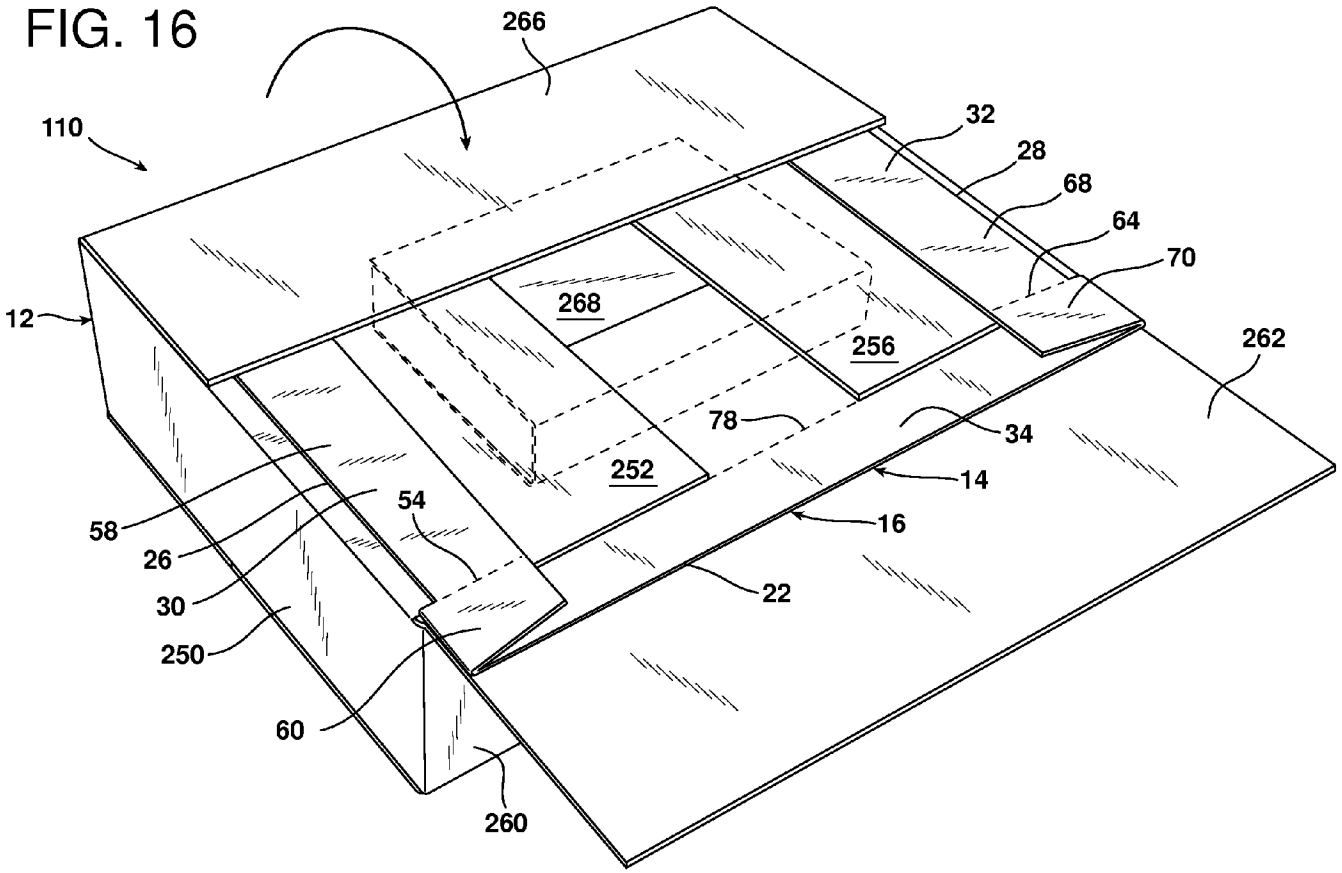
FIG. 16 is a representative perspective view of the packaging assembly of FIG. 15, but having the rear closure flap folded inwardly.
Figure 17:
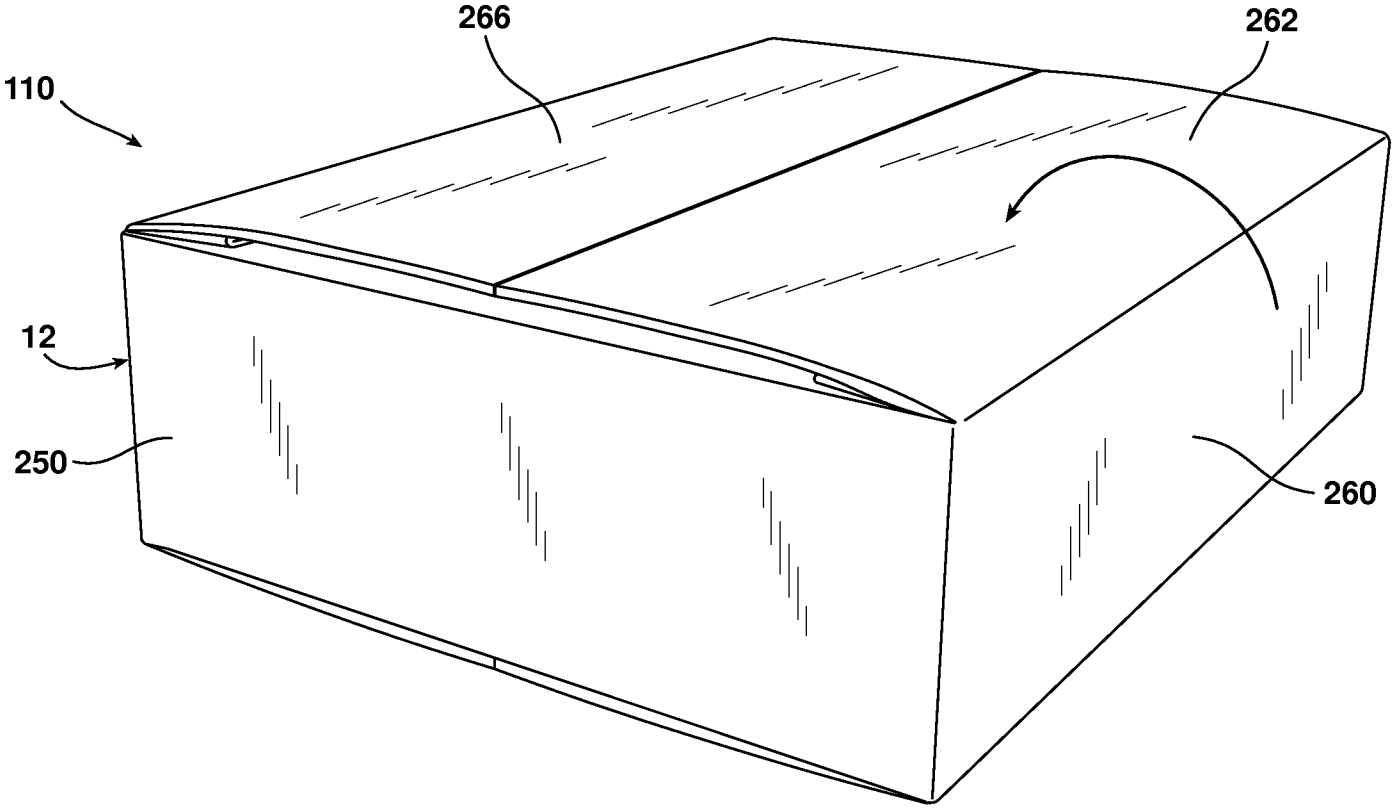
FIG. 17 is a representative perspective view of the packaging assembly of FIGS. 11 to 16, but in the retained position.
Figure 18:
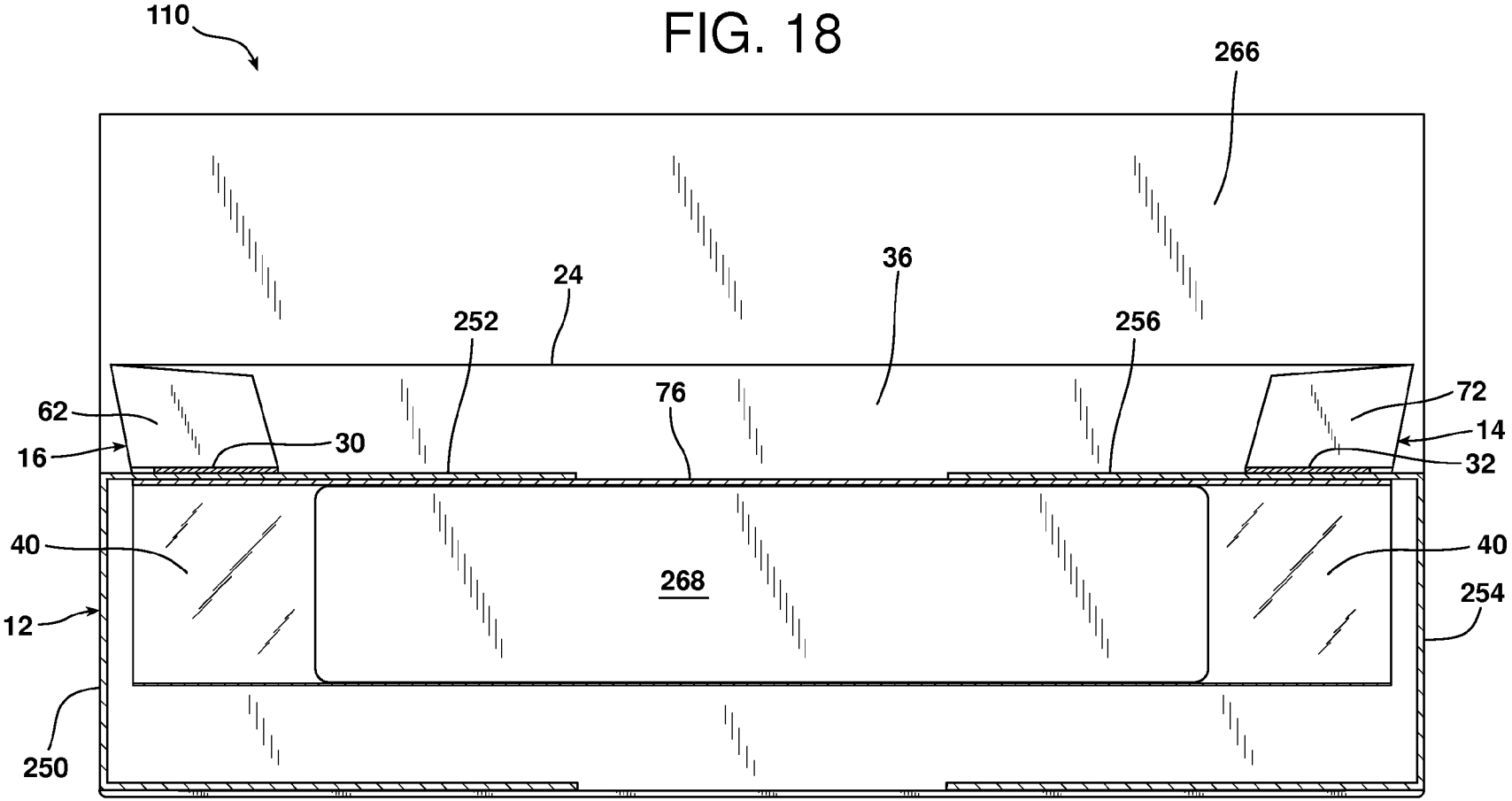
FIG. 18 is a representative sectional view taken along the line 18-18 of FIG. 15.
Figure 19:
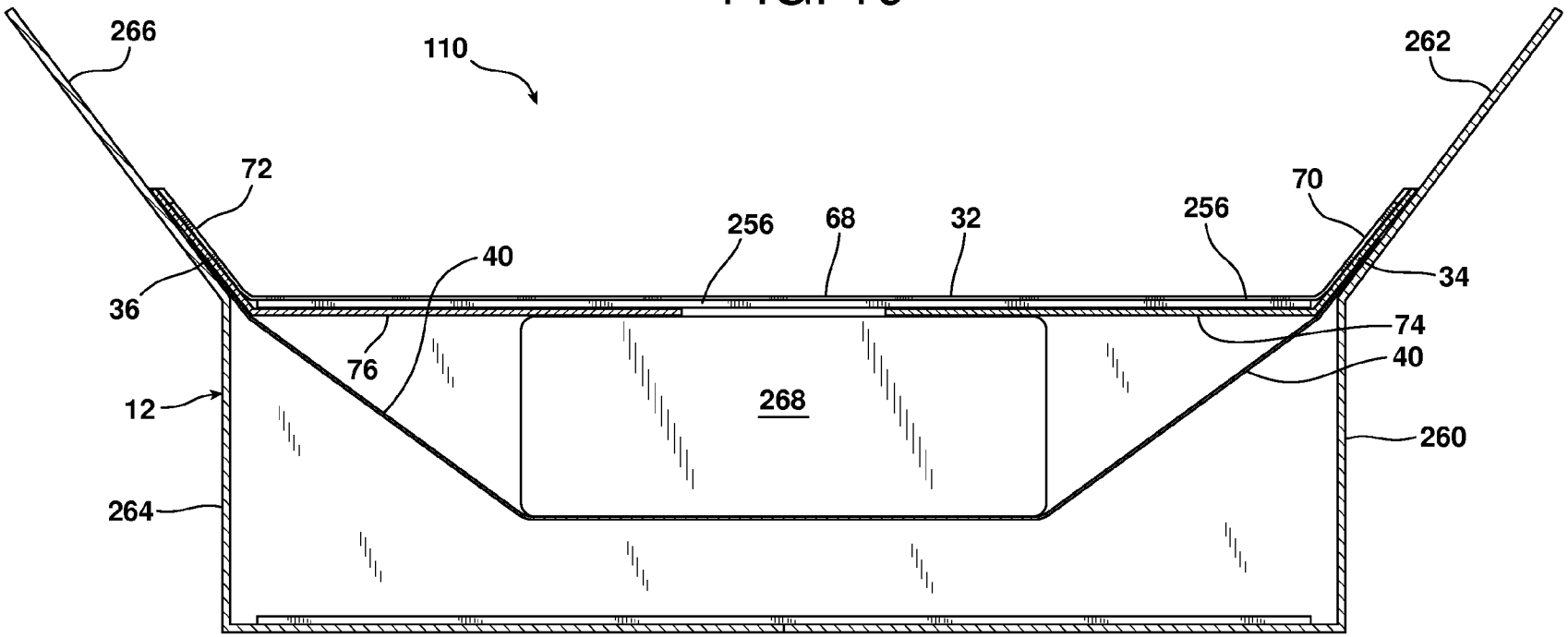
FIG. 19 is a representative sectional view taken along the line 19-19 of FIG. 15.
Figure 26:
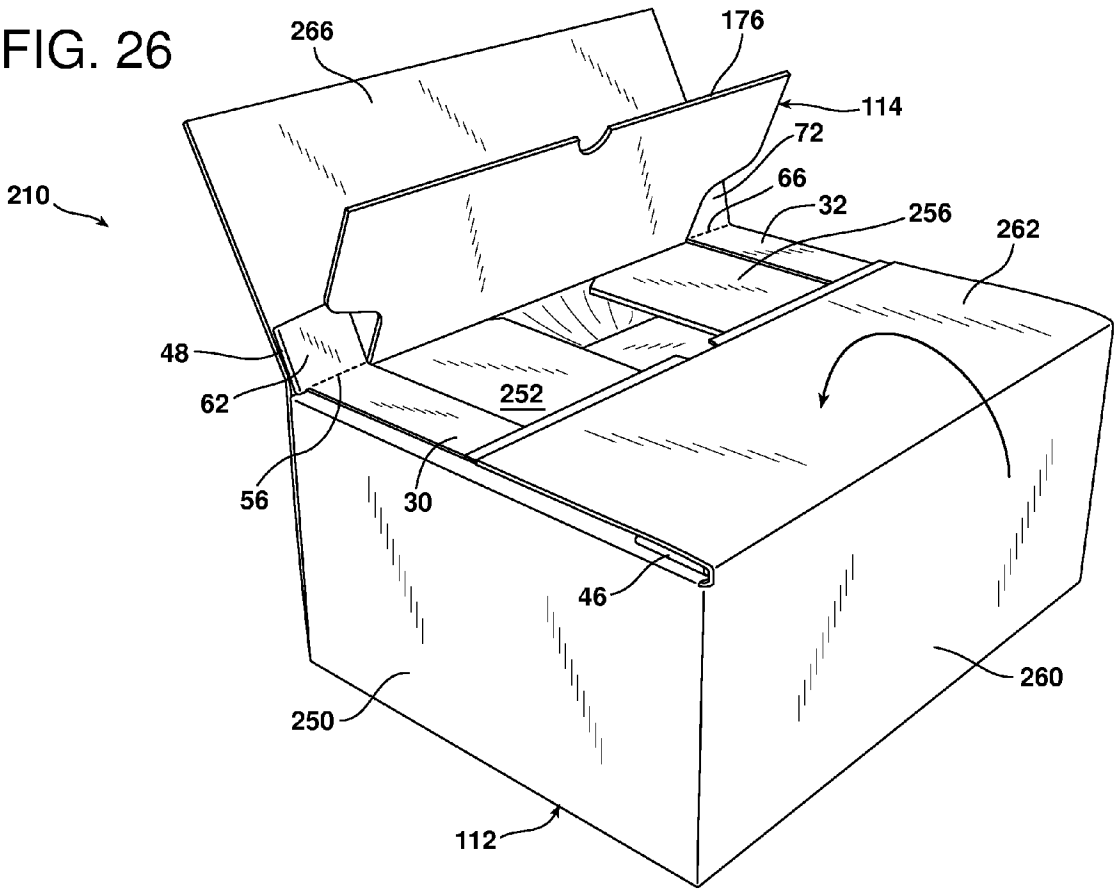
FIG. 26 is a representative perspective view of the packaging assembly of FIG. 25, but having the front closure flap folded inwardly.
Figure 27:
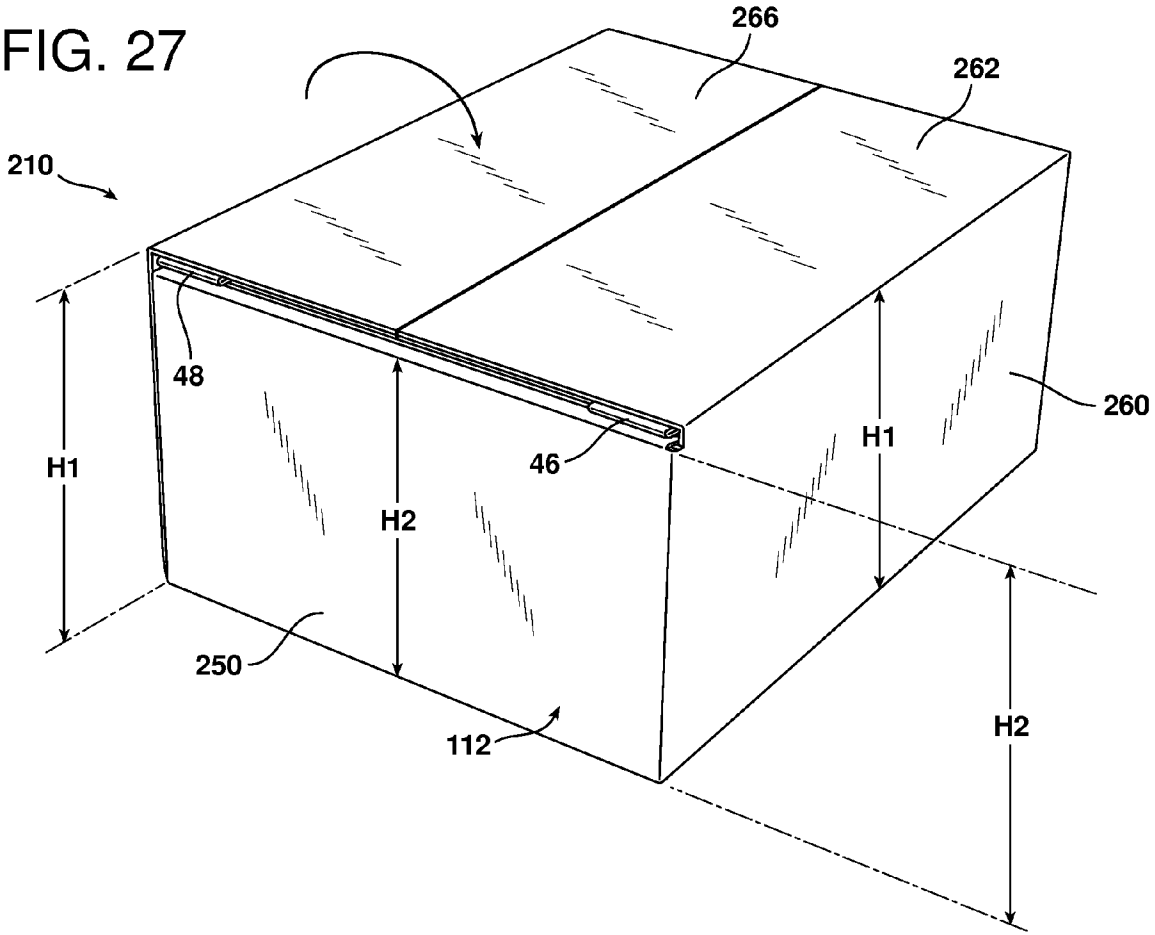
FIG. 27 is a representative perspective view of the packaging assembly of FIGS. 22 to 26, but in the retained position with the box closed.

The packaging assembly, for example, any of packaging assembly 10 (FIGS. 2-9), packaging assembly 110 (FIGS. 11-19), and packaging assembly 210 (FIGS. 22-30), is positionable (i.e., is configured so that the frame and box may be positioned) in a retained position (FIGS. 7, 17, and 27), which has (i) the frame 14, 114 in the installed position (described above) and (ii) the frame/box in at least the following configuration, which for clarity is further described here as a series of steps to place the packaging system in the retained position of FIGS. 7, 17, and 27:

the left panel flap 30 and the left closure flap 252 are folded inwardly to place the left panel flap on top of the left closure flap (FIGS. 5-7; 15-17; 25-27);

the right panel flap 32 and the right closure flap 256 are folded inwardly to place to the right panel flap on top of the right closure flap (FIGS. 5-7; 15-17; 25-27);

the front panel flap is folded inwardly on top of the left panel flap and the right panel flap (FIGS. 7, 17, 26-27);

the rear panel flap is folded inwardly on top of the left panel flap and the right panel flap (FIGS. 6-7, 16-17, 27);

the front closure flap is folded inwardly on top of the front panel flap (FIGS. 7, 17, 26-27); and the optional rear closure flap (if present) is folded inwardly on top of the rear panel flap (FIGS. 6-7, 16-17, 27) or if not present (e.g., in the case of STE or RTE boxes) the front closure flap will fold inwardly on top of the rear panel flap (not illustrated).

When a packaging assembly of any of the disclosed embodiments is in the retained position, a product 268 (for example, a book or an electronic device) that has been placed on the sheet 40 is retainable between the sheet 40 and one or more of the left, right, front, and rear closure flaps of the box. For example, in the retained position a product placed on the sheet 40 may be retainable between the sheet 40 and at least one of the front and rear doors.

Beyond this basic description above of the retained position, there are some variations and/or additional detail retained positions of the presently disclosed subject matter, as set forth below.

By way of example, a packaging assembly in the retained position may have the left panel flap 30 folded along the first fold line 46, the second fold line 48, and the left slot 26 to place the left panel flap 30 on top of an inwardly-folded left closure flap 252; and have the right panel flap 32 is folded along the third fold line 50, the fourth fold line 52, and the right slot 28 to place the right panel flap 32 on top of the inwardly-folded right closure flap 256, also as shown in FIGS. 5-7; 15-17; 25-27.

Further, a packaging assembly in the retained position may have the left panel flap 30 folded along the fifth fold line 54 and the right panel flap 32 folded along the seventh fold line 64 to place (a) the left front corner piece 60 between the left flap intermediate portion 58 and the front panel flap 34 and (b) the right front corner piece 70 between the right flap intermediate portion 68 and the front panel flap 34. (FIGS. 7, 17, 26-27.) Also, the retained position may have the left panel flap 30 folded along the sixth fold line 56 and the right panel flap 32 folded along the eighth fold line 66 to place (i) the left rear corner piece 62 between the left flap intermediate portion 58 and the rear panel flap 36 and (ii) the right rear corner piece 72 between the right flap intermediate portion 68 and the rear panel flap 36. (FIGS. 6-7, 16-17, and 27.)

A packaging assembly when placed in the retained position may have a first portion 270 of the sheet 40 between the front panel flap 34 and one or more of the left closure flap 252 and the right closure flap 256; and a second portion 272 of the sheet 40 between the rear panel flap 36 and one or more of the left closure flap 252 and the right closure flap 256. (See FIGS. 4-7, 9.)

Figure 29:
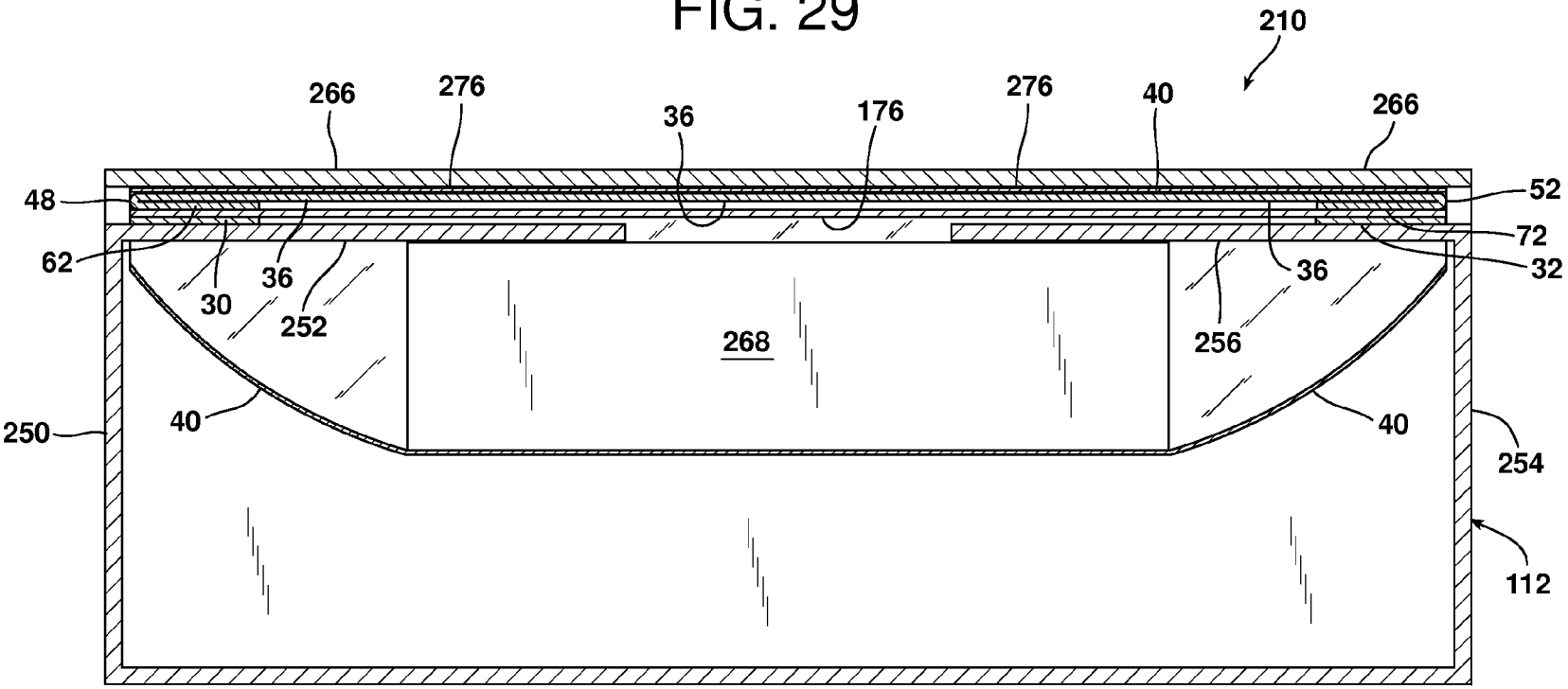
FIG. 29 is a representative sectional view taken along the line 29-29 of FIG. 28.
Figure 30:
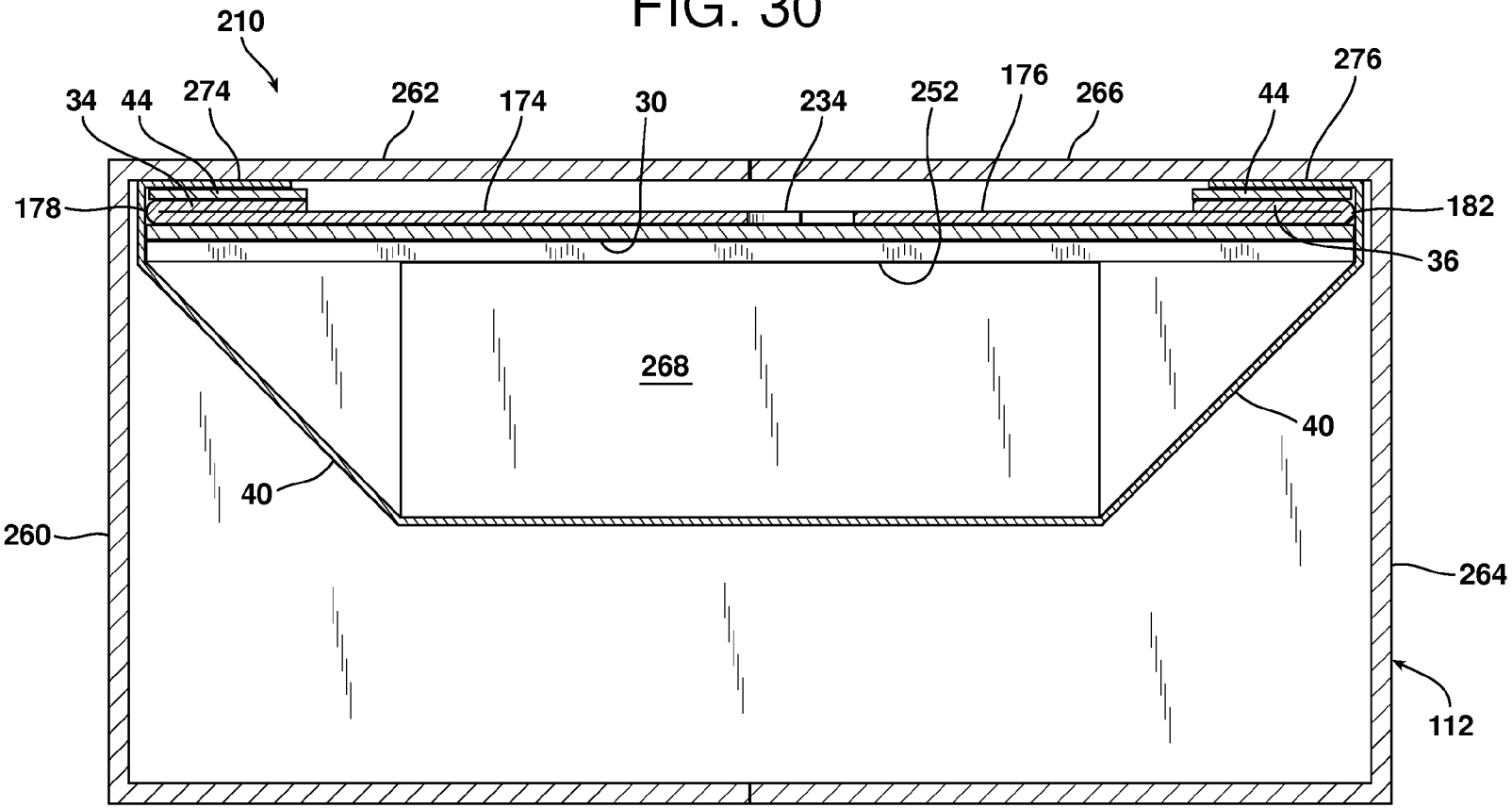
FIG. 30 is a representative sectional view taken along the line 30-30 of FIG. 28.

A packaging assembly in the retained position may have a first portion 274 of the sheet 40 between the front panel flap 34 and the front closure flap 262; and a second portion 276 of the sheet 40 between the rear panel flap 36 and the rear closure flap 266. (FIGS. 29-30.) In the case where the optional rear closure flap is not present, then in the retained position a second portion of the sheet 40 will be between the rear panel flap and the front closure flap of the box (e.g., an STE or RTE box) (not illustrated).

A packaging assembly 10 in the retained position may have the frame in the installed position such that the front and rear doors 74, 76 extend beneath the sheet 40. (See FIGS. 3-7.) Alternatively, a packaging assembly 110 in the retained position may have the front and rear doors 74, 76 extending between (a) the sheet 40 and (b) the left and right closure flaps 252, 256. (See FIGS. 14-17.)

A packaging assembly 210 in the retained position may have the front door 174 extending between (i) the front closure flap 262 and (ii) the left and right closure flaps 252, 256; and the rear door 176 extending between (iii) the rear closure flap 266 and (iv) the left and right closure flaps 252, 256. (See FIGS. 26, 29-30.) In the case where the optional rear closure flap is not present, then the front door may extend between (iii) the front closure flap and (iv) the left and right closure flaps. (Not illustrated.)

After placement of any of the packaging assemblies of the presently disclosed subject matter in the retained position (e.g., such that the box has been closed), the box may be secured to maintain the packaging assembly in the retained position (and, e.g., the box in the closed configuration). For example, the box may be taped, stapled, or otherwise secured closed by methods known in the art.

Manufacture

By using types of machinery well known to those of skill in the field, panel 16 may be cut to the desired shapes and provided with slots, openings, fold lines or lines of detachability, using the known types of machinery, for example, to slit, crease, crimp, emboss, perforate, scored, or otherwise weaken the panel in desired regions. Adhesive 44 may be applied to the panel 16 in selected areas, for example, the attachment zones 42. The sheet 40 may be attached to the panel 16 to make the frame by laminating or adhering the sheet with adhesive 44 to the panel. The sheet material may be provided in roll form, unrolled, and then cut to the desired length and width either before or after attachment to the panel. The packaging assembly comprising the frame and box may be provided or shipped having both configured in a lay flat arrangement. Such configurations may facilitate the provision of multiple frames in a convenient stacked or bundled arrangement (not illustrated). Box 12 may also be provided in a lay-flat configuration, and for example, finally assemble completed after shipment to the location for packaging.

Use

A product 268 may be packaged using any of the packaging assemblies disclosed herein. First the packaging assembly comprising a box and frame is provided. The frame may then be positioned in the installed position relative the box. A product 268 is placed on the sheet 40. The packaging assembly is positioned in the retained position, as described herein. As a result, the product 268 is retained between the sheet 40 and one or more of the left, right, front, and rear closure flaps.

Figure 3:
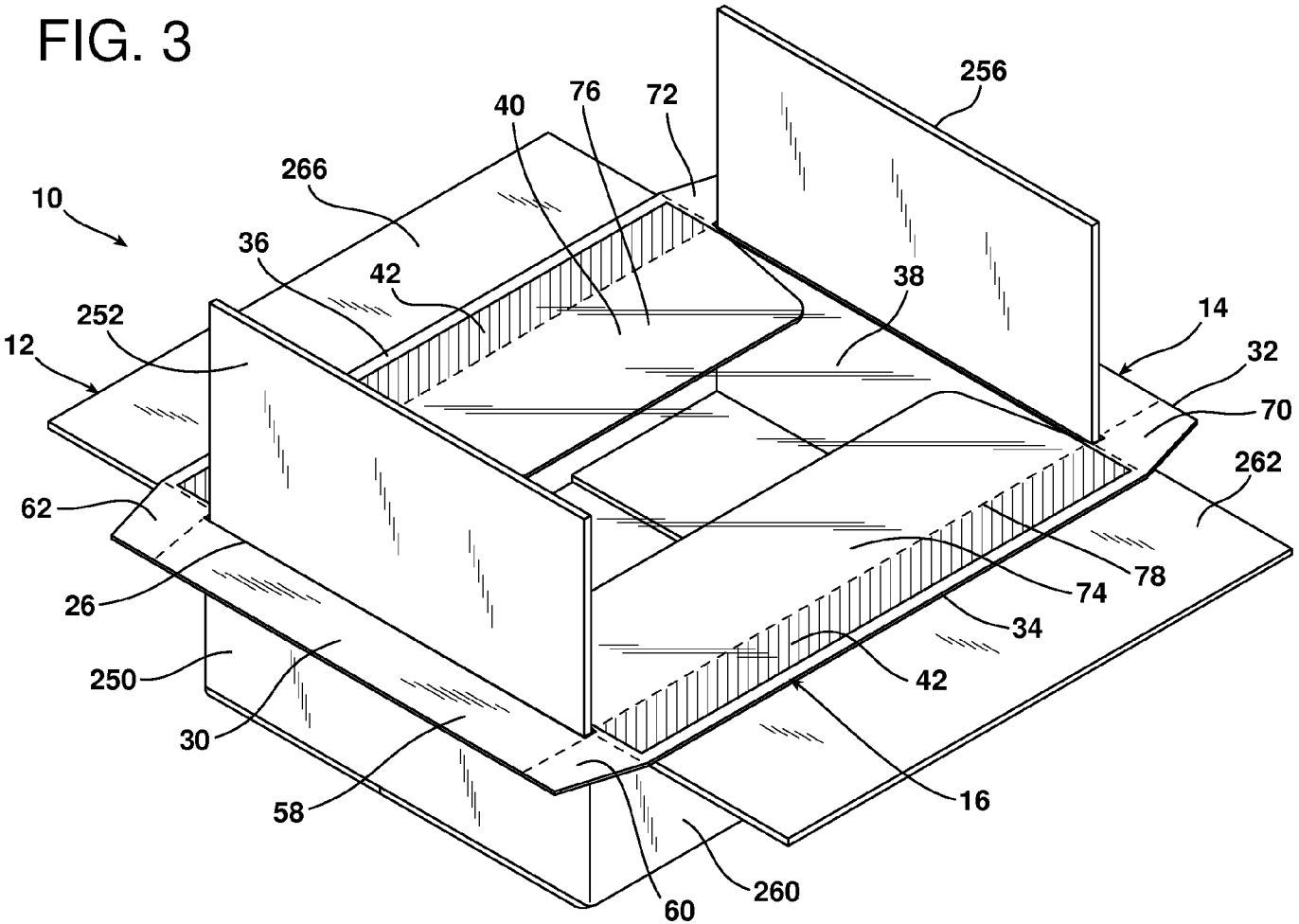
FIG. 3 is a representative perspective view of the packaging assembly of FIG. 2, but having the frame in an installed position.
Figure 4:
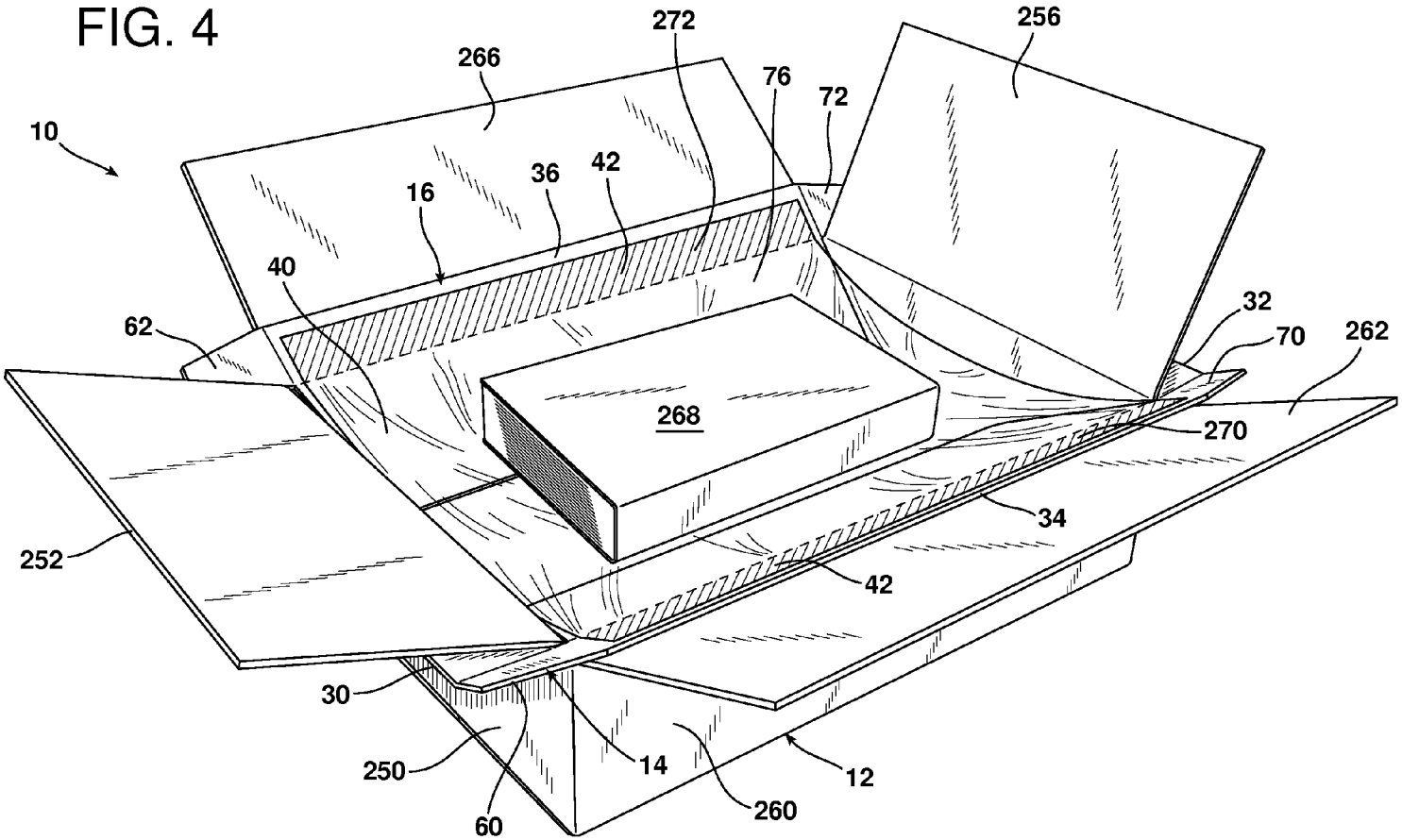
FIG. 4 is a representative perspective view of the packaging assembly of FIG. 3, but having a product to be packaged placed on the sheet.

Using the embodiment of FIGS. 2-9, where the frame of the packaging assembly comprises one or more doors, then the frame may be positioned in an installed position having the doors facing downwardly relative the sheet 40 and the top of the box. (FIGS. 2-4.) A product may be placed on the sheet 40. (FIG. 4.) Next, the left and right closure flaps may be folded so that one or both of the left and right closure flaps engages the product on the sheet 40. (FIGS. 5-6.) The left and right panel flaps may be folded (e.g., simultaneously) on top of the left and right closure flaps, respectively. (FIGS. 5-6.) The front and rear panel flaps may be folded on top of the front and rear doors, respectively. (FIGS. 6-7.) The front and rear closure flaps (or just the front closure flap where the rear closure flap is not present) may be folded to close the box. (FIG. 7.) This latter step may be conducted simultaneously with the folding of the front and rear panel flaps. As a result, the product is retained between the sheet and one or more of the left, right, front, and rear closure flaps.

Figure 11:
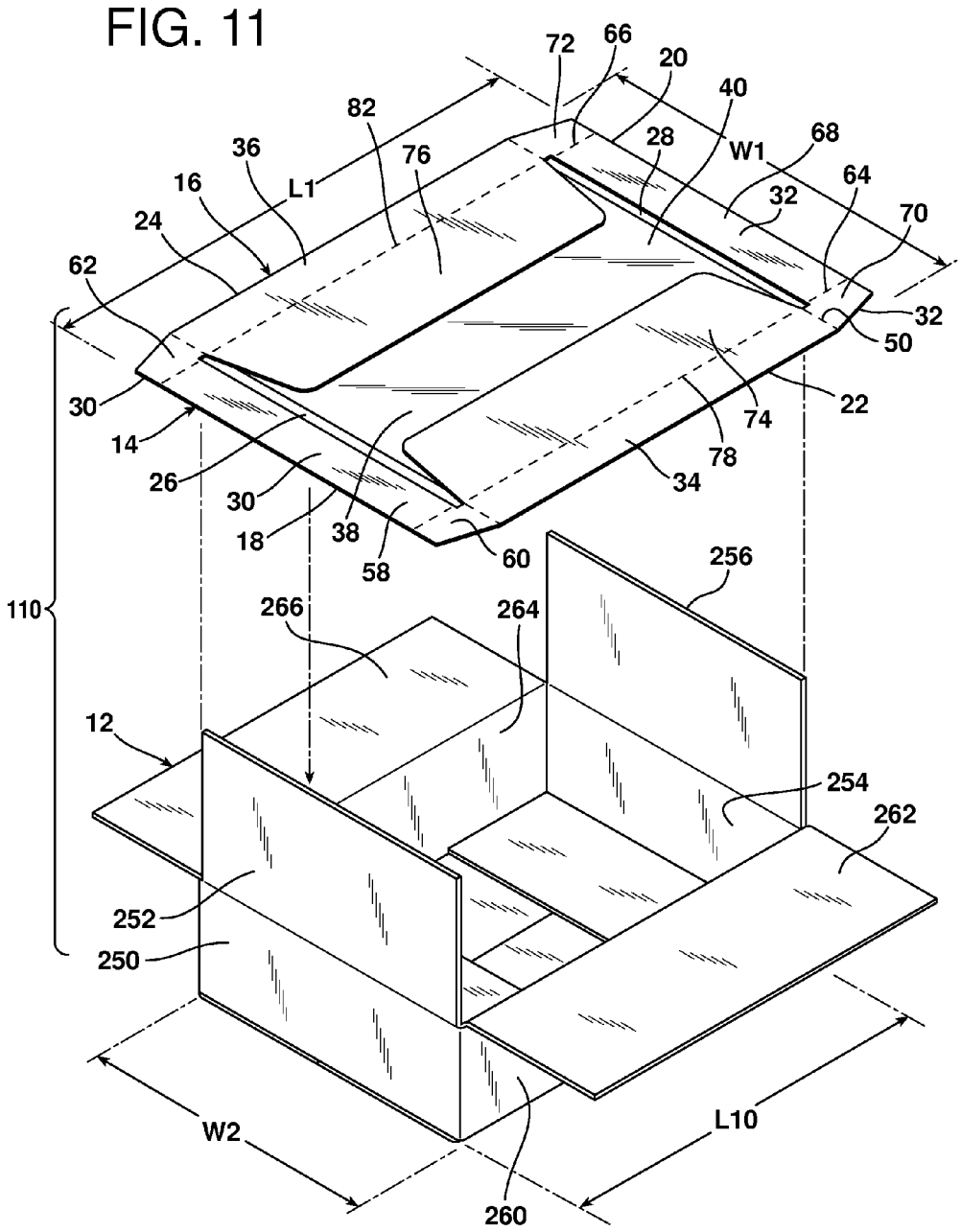
FIG. 11 is a representative perspective view of the frame of FIG. 10 and a box that make up a packaging assembly embodiment of the presently disclosed subject matter.
Figure 12:
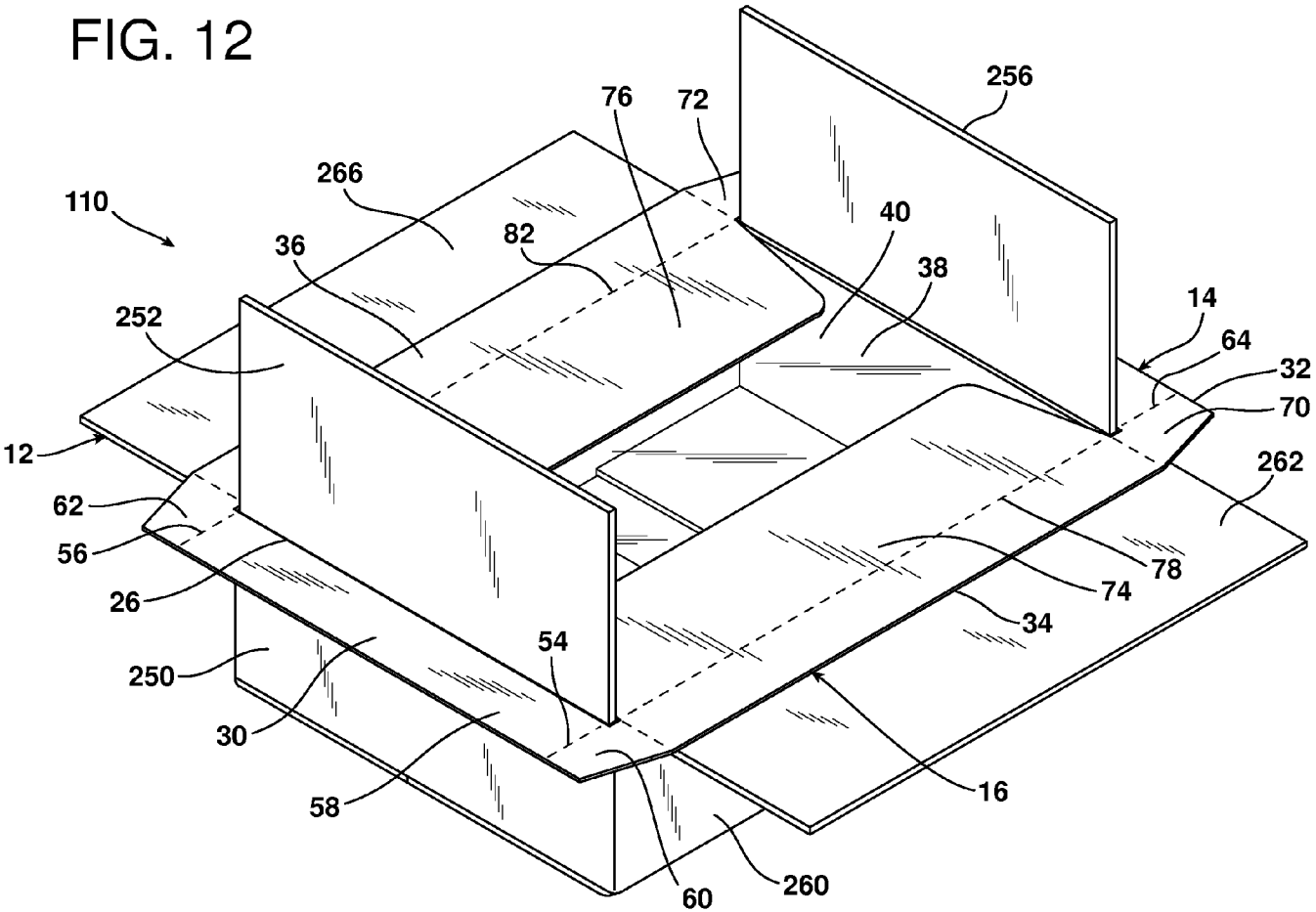
FIG. 12 is a representative perspective view of the packaging assembly of FIG. 11, but having the frame in an installed position.
Figure 13:
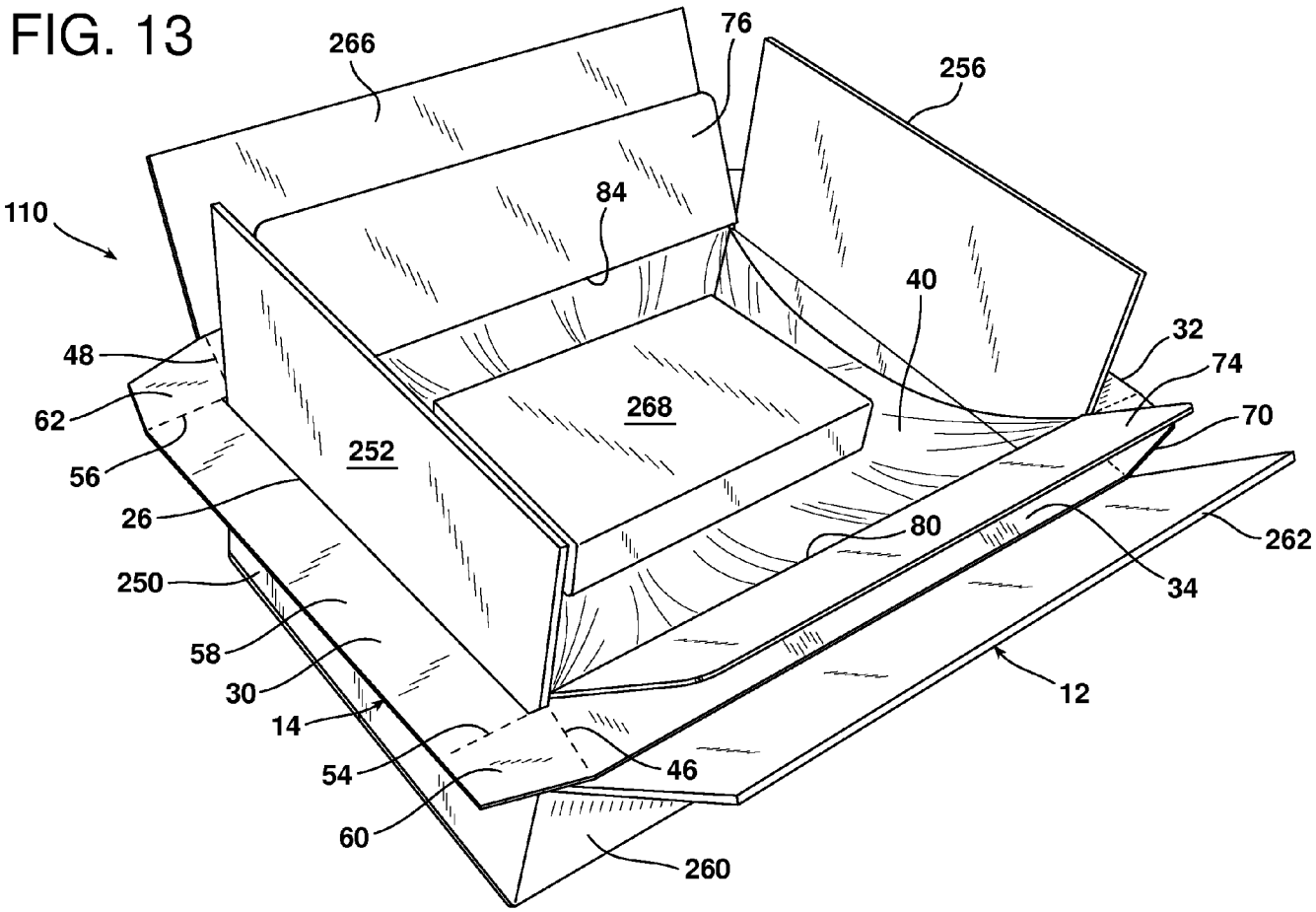
FIG. 13 is a representative perspective view of the packaging assembly of FIG. 12, but having the front and rear doors folded upwardly to provide access to place a product to be packaged on the sheet.
Figure 14:
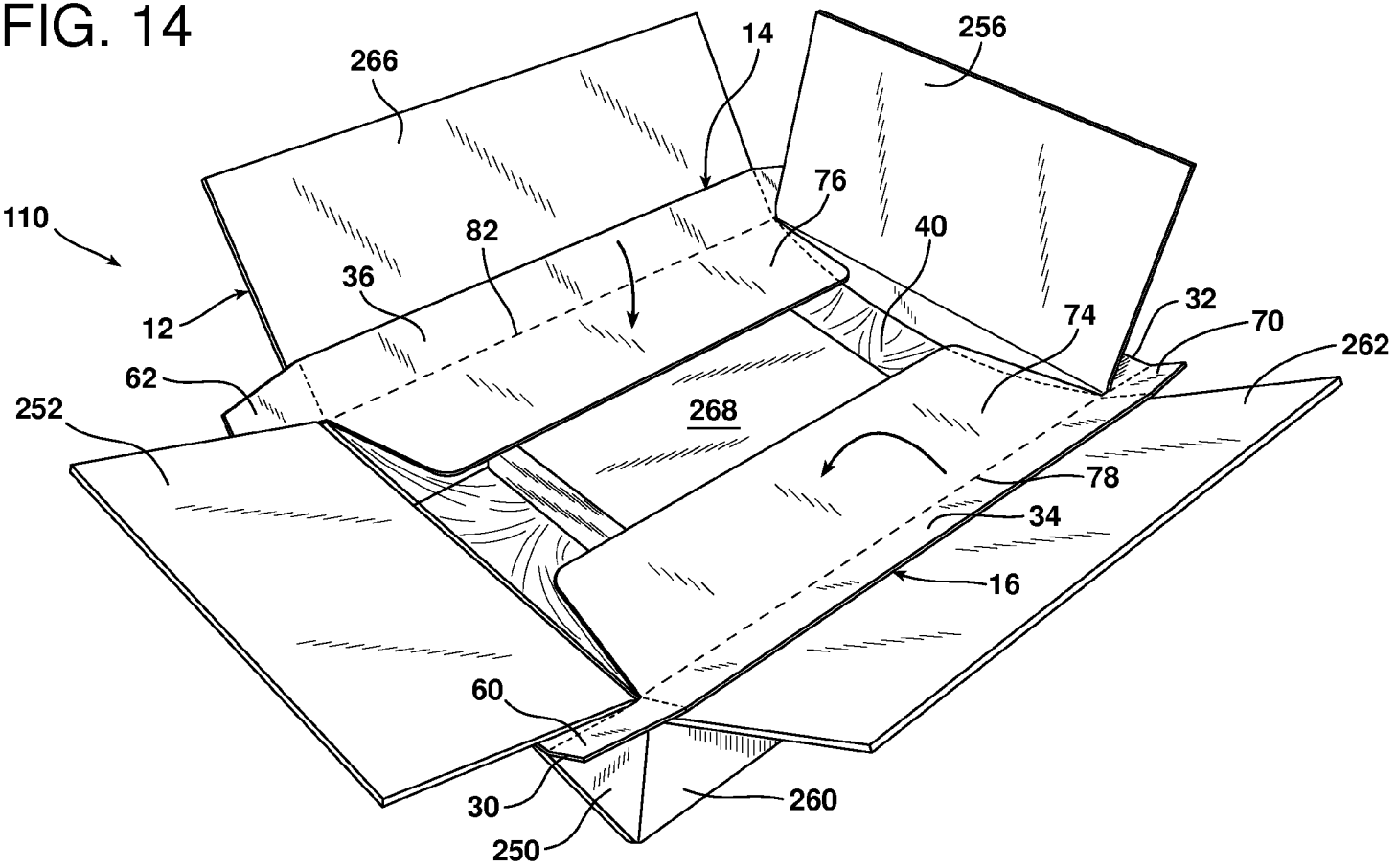
FIG. 14 is a representative perspective view of the packaging assembly of FIG. 13, but having the front and rear doors folded downwardly to place the product between the sheet and the front and rear doors.
Figure 15:
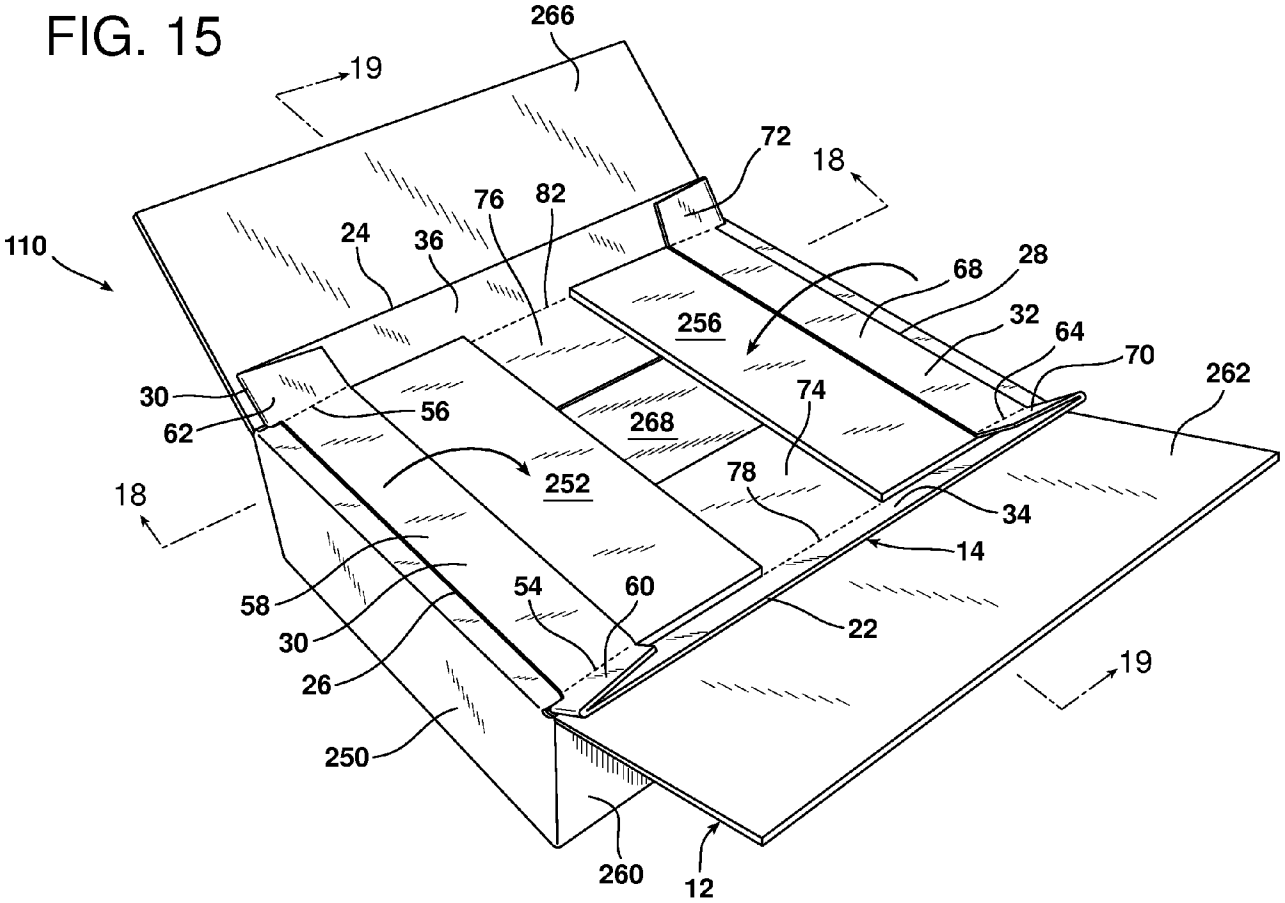
FIG. 15 is a representative perspective view of the packaging assembly of FIG. 14, but having the left and right closure flaps of the box folded inwardly.

Using the embodiment of FIGS. 11-20, where the frame of the packaging assembly comprises one or more doors, then the frame may be positioned in an installed position having the doors facing upwardly relative the sheet 40 and the top of the box. (FIGS. 11-12.) The front and rear doors may be lifted so that the product 268 may be placed on the sheet 40. (FIG. 13.) Next, the front and rear doors may be folded so that one or both of the front and rear doors 74, 76 engages the product on the sheet 40. (FIG. 14.) The left and right closure flaps 252, 256 may be folded inwardly to a closed position. (FIG. 15.) The left and right panel flaps may be folded (e.g., simultaneously with the folding of the left and right closure flaps) on top of the left and right closure flaps, respectively. (FIG. 15.) The front and rear panel flaps may be folded on top of the left and right panel flaps. (FIG. 16-17.) The front and rear closure flaps (or just the front closure flap where the rear closure flap is not present) may be folded to close the box. (FIG. 17.) As a result, the product is retained between the sheet and one or more of the left, right, front, and rear closure flaps.

Figure 22:
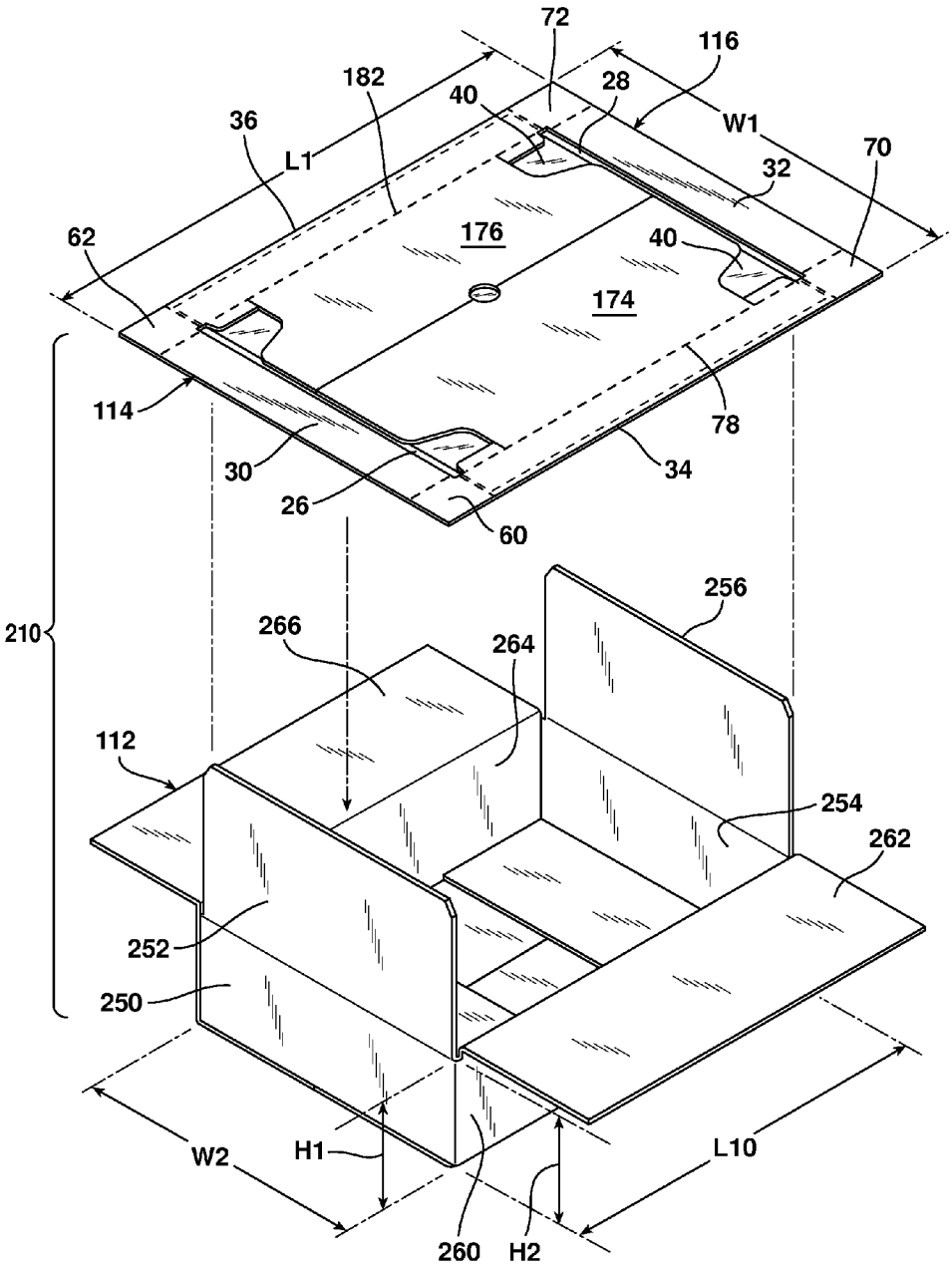
FIG. 22 is a representative perspective view of the frame of FIG. 20 and a box that make up another packaging assembly embodiment of the presently disclosed subject matter.
Figure 23:
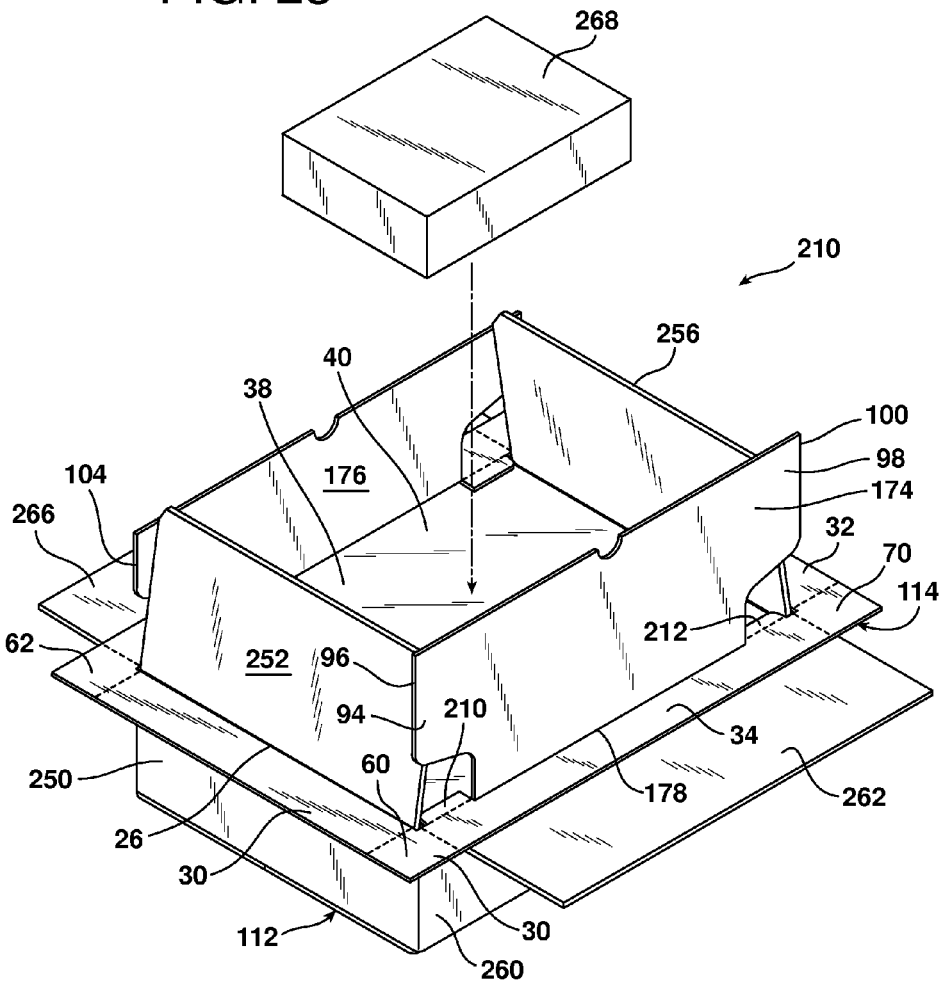
FIG. 23 is a representative perspective view of the packaging assembly of FIG. 22, but having the frame in an installed position and the front and rear doors folded in the upward position.
Figure 28:
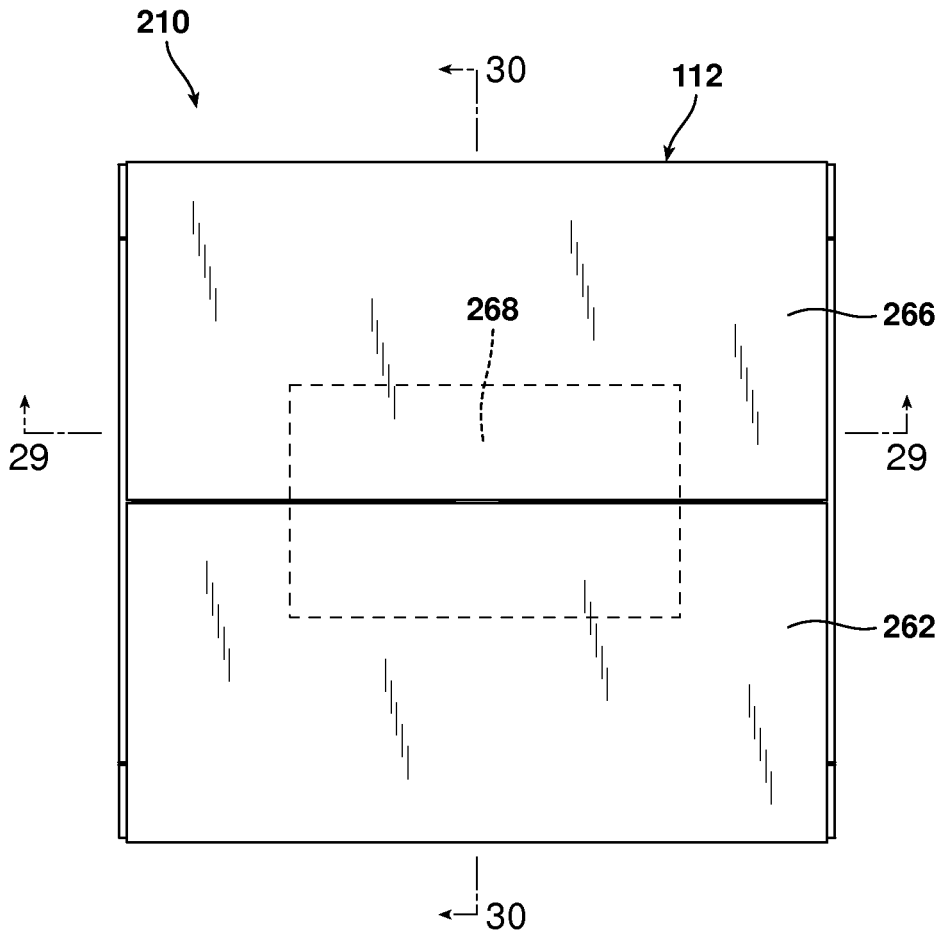
FIG. 28 is a representative top down plan view of the packaging assembly of FIG. 27.

Using the embodiment of FIGS. 22-30, where the frame of the packaging assembly comprises one or more doors, then the frame may be positioned in an installed position having the doors facing upwardly relative the sheet 40 and the top of the box. (FIG. 22.) The front and rear doors may be lifted so that the product 268 may be placed on the sheet. (FIGS. 23-24). The left and right closure flaps may be folded so that one or both of the left and right closure flaps engages the product 268 on the sheet 40. (FIGS. 25-26.) The left and right panel flaps may be folded (e.g., simultaneously with the folding of the left and right closure flaps) on top of the left and right closure flaps, respectively. (FIGS. 25-26.) The front and rear doors may be folded on top of the left and right panel flaps. (FIGS. 26-27.) The front and rear panel flaps may be folded on top of the front and rear doors, respectively. (FIGS. 26-27.) The front and rear closure flaps (or just the front closure flap where the rear closure flap is not present) may be folded to close the box. (FIG. 27-28.) As a result, the product is retained between the sheet and one or more of the left, right, front, and rear closure flaps. One or more of the folding of the front and rear doors, the front and rear panel flaps, and the front and rear closure flaps may occur simultaneously.

As part of the step of lifting the front and rear doors, the lifting step may lift the front and rear doors to extend beyond the distance between the left and right closure flaps, such that the front and rear doors are held in an upward orientation, as shown in FIGS. 23-24. Further, the step of folding of the left and right closure flaps may place them beneath the front door fold line and the rear door fold line. In practice, this may "snap" or securely hold the left and right closure flaps in position.

The folding of the left closure flap and the left panel flap may be conducted to occur simultaneously, and further the folding of the right closure flap and the right panel flap may also be conducted to occur simultaneously. The dimensions and/or configuration for the cutaway openings 226, 228, 230, 232 (e.g., having a arcuate configuration) and the lengths L2, L3, L5 and L7 of the left and right panel flaps and the front and rear doors (e.g., as shown in FIG. 20) may permit the left panel flap 30 and the right panel flap 32 to be folded inwardly without being blocked while the front door 174 and the rear door 176 are in an upward orientation, for example, as shown in FIG. 25.

Also, the folding of the front door, the front panel flap, and the front closure flap may be conducted to occur simultaneously; and the folding of the rear door, the rear panel flap, and the rear closure flap may be conducted to occur simultaneously.

Any numerical value ranges recited herein include all values from the lower value to the upper value in increments of one unit provided that there is a separation of at least 2 units between any lower value and any higher value. As an example, if it is stated that the amount of a component or a value of a process variable (e.g., temperature, pressure, time) may range from any of 1 to 90, 20 to 80, or 30 to 70, or be any of at least 1, 20, or 30 and/or at most 90, 80, or 70, then it is intended that values such as 15 to 85, 22 to 68, 43 to 51, and 30 to 32, as well as at least 15, at least 22, and at most 32, are expressly enumerated in this specification. For values that are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. The definitions and disclosures set forth in the present Application control over any inconsistent definitions and disclosures that may exist in an incorporated reference. All references to ASTM tests are to the most recent, currently approved, and published version of the ASTM test identified, as of the priority filing date of this application. Each such published ASTM test method is incorporated herein in its entirety by this reference.

What is claimed is:

1. A frame useful in a packaging assembly for retaining a product within a box, the box having a left wall, a left closure flap foldably connected to the top of the left wall, a right wall opposing the left wall, a right closure flap foldably connected to the top of the right wall, a front wall extending from the left wall to the right wall, a rear wall opposing the front wall and extending from the left wall to the right wall, a box length from the left wall to the right wall, and a box width from the front wall to the rear wall, the frame comprising:

(i) a panel having:

a panel length from the left edge to the right edge of the panel, the panel length being greater than the box length; and a panel width from the front edge to the rear edge of the panel, the panel width being greater than the box width;

wherein the panel defines:

a left slot configured to receive the left closure flap of the box; and a right slot configured to receive the right closure flap of the box;

wherein the panel comprises:

a left panel flap extending from the left slot to the left edge of the panel;

a right panel flap extending from the right slot to the right edge of the panel;

a front panel flap extending from the left panel flap to the right panel flap; and a rear panel flap extending from the left panel flap to the right panel flap;

wherein:

the left panel flap is foldably connected to the front panel flap and to the rear panel flap;

the right panel flap is foldably connected to the front panel flap and the rear panel flap; and the panel defines a panel opening circumscribed by the left, right, front, and rear panel flaps; and (ii) a sheet attached to the front panel flap and the rear panel flap and extending over the panel opening.

2. The frame of claim 1 wherein:

the left panel flap is delineated from the front panel flap by a first fold line aligned with the left slot;

the left panel flap is delineated from the rear panel flap by a second fold line aligned with left slot;

the right panel flap is delineated from the front panel flap by a third fold line aligned with the right slot; and the right panel flap is delineated from the rear panel flap by a fourth fold line aligned with the right slot.

3. The frame of claim 2 wherein:

a fifth fold line and a sixth fold line extend generally perpendicularly from the left slot to delineate the left panel flap into (i) a left flap intermediate portion between the fifth and sixth fold lines and (ii) a left front corner piece and a left rear corner piece on opposing ends of the left flap intermediate portion; and a seventh fold line and an eighth fold line extend generally perpendicularly from the right slot to delineate the right panel flap into (iii) a right flap intermediate portion between the seventh fold line and the eighth fold line and (iv) a right front corner piece and a right rear corner piece on opposing ends of the right flap intermediate portion.

4. The frame of claim 3 wherein the panel further comprises:

a front door foldably connected to the front panel flap and extending into the panel opening; and a rear door foldably connected to the rear panel flap and extending into the panel opening.

5. The frame of claim 4 wherein:

(a) the front door is foldably connected to the front panel flap along a front door fold line along a front panel flap edge adjacent the panel opening, wherein:

the left panel flap has a left panel flap length taken from the left slot to the left edge of the panel;

the right panel flap has a right panel flap length taken from the right slot to the right edge of the panel;

the front panel flap has a front panel flap length taken from the first fold line to the third fold line;

the front door has a front door length taken along the front door fold line from the left edge of the front door to the right edge of the front door; and the front door length is less than the front panel flap length minus the sum of the left panel flap length and the right panel flap length; and (b) the rear door foldably connected to the rear panel flap along a rear door fold line along a rear panel flap edge adjacent the panel opening, wherein:

the rear panel flap has a rear panel flap length taken from the second fold line to the fourth fold line;

the rear door has a rear door length taken along the rear door fold line from the left edge of the rear door to the right edge of the rear door; and the rear door length is less than the rear panel flap length minus the sum of the left panel flap length and the right panel flap length.

6. The frame of claim 5 wherein:

the front door comprises:

a left door-tab portion at the left edge of the front door distal to the front door fold line;

a right door-tab portion at the right edge of the front door distal to the front door fold line;

a left door-tab portion at the left edge of the rear door distal to the rear door fold line;

a right door-tab portion at the right edge of the rear door distal to the rear door fold line;

wherein:

a front tab spacing length from the left edge of the left door-tab portion of the front door to the right edge of the right door-tab portion of the front door is greater than the front door length; and a rear tab spacing length from the left edge of the left door-tab portion of the rear door to the right edge of the right door-tab portion of the rear door is greater than the rear door length.

7. The frame of claim 6 wherein:

a front left panel tab is foldably connected to the front panel flap between the left panel flap and the front door and extends from the front panel flap into the panel opening; and a front right panel tab is foldably connected to the front panel flap between the right panel flap and the front door and extends from the front panel flap into the panel opening.

8. The frame of claim 7 wherein:

a rear left panel tab is foldably connected to the rear panel flap between the left panel flap and the rear door and extends from the rear panel flap into the panel opening; and a rear right panel tab is foldably connected to the rear panel flap between the right panel flap and the rear door and extends from the rear panel flap into the panel opening.

9. The frame of claim 4 wherein:

the front door defines a left front cutaway opening at the left extent of the front door;

the left front cutaway opening has an area at least as large as the area of the left front corner piece;

the front door defines a right front cutaway opening at the right extent of the front door; and the right front cutaway opening has an area at least as large as the area of the right front corner piece.

10. The frame of claim 4 wherein the front and rear doors are of unequal size.

11. The frame of claim 1 wherein the sheet does not cover the left and right slots.

12. A packaging assembly for retaining a product, the packaging assembly comprising:

(i) the frame of claim 1; and (ii) a box comprising:

a left wall;

a left closure flap foldably connected to the top of the left wall;

a right wall opposing the left wall;

a right closure flap foldably connected to the top of the right wall, a front wall extending from the left wall to the right wall;

a front closure flap foldably connected to the top of the front wall;

a rear wall opposing the front wall and extending from the left wall to the right wall; and optionally a rear closure flap foldably connected to the top of the rear wall, wherein the box has a given box length from the left wall to the right wall, and a given box width from the front wall to the rear wall;

(iii) wherein:

the frame is positionable in an installed position having the left closure flap of the box extending through the left slot of the panel and the right closure flap of the box extending through the right slot of the panel; and the packaging assembly is positionable in a retained position having:

the frame in the installed position;

the left panel flap and the left closure flap folded inwardly to place the left panel flap on top of the left closure flap;

the right panel flap and the right closure flap folded inwardly to place to the right panel flap on top of the right closure flap;

the front panel flap folded inwardly on top of the left panel flap and the right panel flap;

the rear panel flap folded inwardly on top of the left panel flap and the right panel flap;

the front closure flap folded inwardly on top of the front panel flap; and optionally the rear closure flap folded inwardly on top of the rear panel flap, whereby a product placed on the sheet is retainable between the sheet and one or more of the left, right, front, and rear closure flaps.

13. The packaging assembly of claim 12 wherein:

the left panel flap is delineated from the front panel flap by a first fold line aligned with the left slot;

the left panel flap is delineated from the rear panel flap by a second fold line aligned with the left slot;

the right panel flap is delineated from the front panel flap by a third fold line aligned with the right slot; and the right panel flap is delineated from the rear panel flap by a fourth fold line aligned with the right slot;

wherein in the retained position:

the left panel flap is folded along the first fold line, the second fold line, and the left slot to place the left panel flap on top of the inwardly-folded left closure flap; and the right panel flap is folded along the third fold line, the fourth fold line, and the right slot to place the right panel flap on top of the inwardly-folded right closure flap.

14. The packaging assembly of claim 13 wherein:

a fifth fold line and a sixth fold line extend generally perpendicularly from the left slot to delineate the left panel flap into (i) a left flap intermediate portion between the fifth and sixth fold lines and (ii) a left front corner piece and a left rear corner piece on opposing ends of the left flap intermediate portion; and a seventh fold line and an eighth fold line extend generally perpendicularly from the right slot to delineate the right panel flap into (iii) a right flap intermediate portion between the seventh fold line and the eighth fold line and (iv) a right front corner piece and a right rear corner piece on opposing ends of the right flap intermediate portion;

wherein in the retained position:

the left panel flap is folded along the fifth fold line and the right panel flap is folded along the seventh fold line to place (a) the left front corner piece between the left flap intermediate portion and the front panel flap and (b) the right front corner piece between the right flap intermediate portion and the front panel flap; and the left panel flap is folded along the sixth fold line and the right panel flap is folded along the eighth fold line to place (c) the left rear corner piece between the left flap intermediate portion and the rear panel flap and (d) the right rear corner piece between the right flap intermediate portion and the rear panel flap.

15. The packaging assembly of claim 14 wherein in the retained position:

a first portion of the sheet is between the front panel flap and the front closure flap; and a second portion of the sheet is (i) between the rear panel flap and the optional rear closure flap or (ii) between the rear panel flap and the front closure flap.

16. The packaging assembly of claim 14 wherein the panel further comprises:

a front door foldably connected to the front panel flap along a front panel edge adjacent the panel opening; and a rear door foldably connected to the rear panel flap along a rear panel edge adjacent the panel opening;

wherein in the retained position:

the front door extends between (i) the front closure flap and (ii) the left and right closure flaps; and the rear door extends between (iii) either the optional rear closure flap or the front closure flap and (iv) the left and right closure flaps.

17. The packaging assembly of claim 16 wherein the panel further comprises:

(a) the front door foldably connected to the front panel flap along a front door fold line along a front panel edge adjacent the panel opening, wherein:

the left panel flap has a left panel flap length taken from the left slot to the left edge of the panel;

the right panel flap has a right panel flap length taken from the right slot to the right edge of the panel;

the front panel flap has a front panel flap length taken from the first fold line to the third fold line;

the front door has a front door length taken along the front door fold line from the left edge of the front door to the right edge of the front door; and the front door length is less than the front panel flap length minus the sum of the left panel flap length and the right panel flap length; and (b) the rear door foldably connected to the rear panel flap along a rear door fold line along a rear panel edge adjacent the panel opening, wherein:

the rear panel flap has a rear panel flap length taken from the second fold line to the fourth fold line;

the rear door has a rear door length taken along the rear door fold line from the left edge of the rear door to the right edge of the rear door; and the rear door length is less than the rear panel flap length minus the sum of the left panel flap length and the right panel flap length.

18. The packaging assembly of claim 17 wherein in the retained position:

the front door also extends between (i) the front closure flap and (ii) the left and right panel flaps; and the rear door also extends between (iii) either the optional rear closure flap or the front closure flap and (iv) the left and right panel flaps.

19. The packaging assembly of claim 12 wherein in the retained position a product placed on the sheet is retainable between the sheet and at least one of the front and rear doors.

20. A method of packaging a product, the method comprising:

providing the packaging assembly of claim 12;

positioning the frame in the installed position;

placing the product on the sheet; and positioning the packaging assembly in the retained position, whereby the product is retained between the sheet and one or more of the left, right, front, and rear closure flaps.

* * * * *